US005992425A

United States Patent [19]

Teratani et al.

[11] Patent Number: 5,992,425

[45] Date of Patent: Nov. 30, 1999

[54] HAIR ROLLER

[75] Inventors: Toshiko Teratani, Nishinomiya; Mayumi Ueda, Ashiya, both of Japan

[73] Assignee: White House Inc,, Osaka, Japan

[21] Appl. No.: 09/023,418

[22] Filed: Feb. 13, 1998

[51] Int. Cl.[6] ..... A45B 2/00; A45B 2/14

[52] U.S. Cl. ..... 132/245; 132/226; 132/252; 132/246; 132/248

[58] Field of Search ..... 132/245, 246, 132/247, 248, 251, 252, 260, 264, 272, 226

[56] References Cited

U.S. PATENT DOCUMENTS

| | | | |
|---|---|---|---|
| 2,140,583 | 12/1938 | Jacobs | 132/246 |
| 2,524,266 | 10/1950 | Licastro | 132/246 |
| 2,649,097 | 8/1953 | Chernack | 132/246 |
| 3,358,698 | 12/1967 | Blanchard | 132/252 |
| 3,653,392 | 4/1972 | Hassey et al. | 132/252 |
| 4,234,000 | 11/1980 | Pizzino | 132/252 |
| 4,513,760 | 4/1985 | Tihonovich | 132/248 |
| 5,588,449 | 12/1996 | Falcon | 132/252 |
| 5,839,450 | 11/1998 | Glasscock | 132/252 |

*Primary Examiner*—Gene Mancene
*Assistant Examiner*—Pedro Philogene
*Attorney, Agent, or Firm*—Armstrong, Westerman, Hattori, McLeland & Naughton

[57] ABSTRACT

A hair roller is provided around which hair can be wound easily with tension toward the outside acting on the hair, without a fear that the distal ends of the hair are folded, with ease in handling, and with good operativity, and with which the wound state can be maintained, regardless of the level of skill, i.e., even by a beautician who lacks experience or an amateur. A hair roller comprises a rod having a hair winding portion where at least a portion around which hair is wound is resiliently restitutively compressed and deformed and also having a hair distal end retaining member for retaining distal ends of hair and a wind maintaining member for maintaining the state of hair wound around the rod with tension.

26 Claims, 23 Drawing Sheets

HAIR ROLLER

BACKGROUND OF THE INVENTION

1. Field of the Invention

The present invention relates to a hair roller, and more particularly, to a hair roller onto which hair is wound with tension toward the outside acting on the hair utilizing shape restitutive force.

2. Description of the Related Art

Regardless of age or sex, people attempt to show their originality or to create an atmosphere by adopting various kinds of hairstyles. Although a hairstyle can of course be expressed by a haircut, there are many cases in which a hairstyle is expressed by curling hair the curled state of which is retained by a hair roller.

As the hair roller, a hollow cylindrical member such as a rod is often used. FIG. 31 shows, as such an example, a hair roller used when hair is permed. A hair roller 110 shown in the figure comprises a rod 111 around the surface of which hair is wound, a rubber band 112 for fastening the rod 111 along the longitudinal direction of the rod 111 with hair wound around it, and a pin 113 for forming a space between the rubber band 112 fastening the rod 111 and hair wound around the rod 111 for the purpose of preventing a mark of the rubber band 112 from remaining on the hair wound around the rod 111.

The process of winding hair onto the conventional rod 111 is shown in FIG. 32. First, an appropriate amount of hair 120 is scooped up with a comb or the like, and the hair 120 is sandwiched by a sheet body 114 or the like formed of paper with good water absorption or the like folded in two (FIG. 32A). Here, the hair 120 is easy to handle if the hair 120 is moistened in advance. Next, the hair 120 is wound onto the rod 111 together with the sheet body 114 from the side of distal ends 121 of hair (FIG. 32B). Then, the rod 111 with the hair 120 wound around the rod 111 is fastened by the rubber band 112 along the longitudinal direction of the rod 111 (FIG. 32C). After that, the pin 113 is put between the rubber band 112 and the hair 120 for the purpose of preventing a mark of the rubber band 112 from remaining on the hair (FIG. 32D).

In case a curl wound in the longitudinal direction is desired, a nearly conical long rod 115 as shown in FIG. 33 is used, and hair is spirally wound around the rod 115.

The rods 111 and 115 are used, other than in perming, when hair wound onto the rod is curled by heated by a hair drier and the like or by maintaining the wound state for a predetermined time period, for example.

However, there are problems in case hair is wound onto a conventional hair roller. More specifically, in order to beautifully curl hair, it is desirable to curl hair onto a rod with tension. However, since the surface of the rods 111 and 115 is slippery, the work at the beginning of winding hair is especially difficult. Further, since the rods 111 and 115 are generally made of a nonresilient material such as plastic, it requires practice to wind hair with tension toward the outside acting on the hair.

Still further, if a beautician who lacks experience or an amateur winds the hair 120 onto the rod 111 or 115, the hair is often wound with the distal ends 121 of hair or the like being folded. If the hair is permed with this state, the folded state of the distal ends 121 of hair is fixed, and it is difficult to improve the state even with heat by a hair drier. Still further, even if the rubber band 112 or the like fastens the rod 111 with the hair wound around the rod 111 for the purpose of preventing the rod 111 from rotatably moving, if the position of the fastening is inappropriate, the rod 111 easily rotatably moves and it is difficult to retain the wound state.

As described in the above, since it requires skill to some extent to wind the hair 120 around the conventional rod 111 or 115, and especially, since it requires practice to wind the hair 120 with tension toward the outside acting on the hair 120, there are problems that, if a beautician who lacks experience or an amateur carries out the above described work, it takes a lot of time to wind the hair 120 or the finished hairstyle is unsatisfactory.

The present invention is made in view of the above, and an object of the invention is to provide a hair roller around which hair can be wound easily with tension toward the outside acting on the hair, without a fear that the distal ends of the hair are folded, with ease in handling, and with good operativity, so that the wound state can be maintained regardless of the level of skill, i.e., even by a beautician who lacks experience or an amateur.

SUMMARY OF THE INVENTION

In order to attain the above object, according to one aspect of the present invention, a hair roller comprises a rod having a hair winding portion where at least a portion around which hair is wound is resiliently restitutively compressed and deformed and also having a hair distal end retaining means for retaining distal ends of hair, and a wind maintaining means for maintaining the state of hair wound around the rod with tension.

The rod may be, for example, a rod having a forked portion separated in two by a slit piercing the hair winding portion as a hair distal end retaining means for retaining distal ends of hair. When the rod is a rod with a hole formed substantially through the center of each separated piece forming the forked portion, the wind maintaining means preferably comprises clip pieces which can be inserted in the hole and are opened and closed by a lever.

The wind maintaining means may be, for example, a covering body having a plurality of covering pieces which are opened by a lever and can cover the rod, and the wind maintaining means maintains the state of hair wound around the rod with tension by pressing by inner surfaces of the covering pieces when the covering body is closed (this wind maintaining means is hereinafter referred to as wind maintaining means A). The wind maintaining means may also be a wind maintaining means for maintaining the state of hair wound around the rod with tension comprising a C-shaped ring portion for holding the rod around which hair is wound and a leg portion as a rotation-stop extended from an end of the ring portion (this wind maintaining means is hereinafter referred to as wind maintaining means C).

According to another aspect of the present invention, a hair roller comprises a hollow rod having a hair winding portion cut by a first slit over the full length of the rod to be resiliently restitutively compressed and deformed and also having a second slit formed in a longitudinal middle portion of the hair winding portion as a hair distal end retaining means for retaining distal ends of hair, and a wind maintaining means for maintaining the state of hair wound around the rod with tension. In this case, the wind maintaining means may be the wind maintaining means A, the wind maintaining means C, or a substantially U-shaped tube-like body in which both end portions are outlets for liquid or gas and an inlet for the liquid or gas is formed between the both end portions, and which is the wind maintaining means for maintaining the state of hair wound around the rod with tension by being provided on the hair winding portion so as to press the hair winding portion (this wind maintaining means is hereinafter referred to as wind maintaining means B). In this case, it is preferable that a third slit for retaining hair on the proximal side or distal ends of hair wound around the rod is formed on one end portion or both end portions of the rod as the wind maintaining means for maintaining the state of hair wound around the rod with tension. In case of this structure, though unnecessary, the wind maintaining means A, B, or C may be used together with this structure.

According to still another aspect of the present invention, a hair roller comprises a rod having a hair winding portion where at least a portion around which hair is wound is resiliently restitutively compressed and deformed and also having a slit formed in the hair winding portion as a hair distal end retaining means, and a wind maintaining means for maintaining the state of hair wound around the rod with tension. In this case, a pair of slits for retaining hair on the proximal side or distal ends of hair wound around the rod may be formed on both end portions of the rod, one of the slits being the hair distal end retaining means and the other of the slits being the wind maintaining means for maintaining the state of hair wound around the rod with tension.

A specific example of the hair roller according to the above-described aspect of the present invention may be a hair roller wherein the rod has a slit piercing a longitudinal middle portion of the hair winding portion as the hair distal end retaining means, and the wind maintaining means is the wind maintaining means A. Not only the wind maintaining means A but also the wind maintaining means B or C may be the wind maintaining means.

Another specific example of the hair roller according to the above-described aspect of the present invention may be a hair roller wherein the rod has a slit over the full length of the hair winding portion or formed in a longitudinal middle portion of the hair winding portion so as not to pierce the hair winding portion and a through hole opened in a hair winding surface to the slit together as the hair distal end retaining means, and the wind maintaining means is the wind maintaining means A. Not only the wind maintaining means A but also the wind maintaining means B or C may be the wind maintaining means.

Still another specific example of the hair roller according to the third aspect of the present invention may be a hair roller wherein the rod has a slit over the full length of the hair winding portion or formed in a longitudinal middle portion of the hair winding portion so as not to pierce the hair winding portion and a first through hole opened in a hair winding surface to the slit together as the hair distal end retaining means, and also has a second through hole formed in a rod body so as to lead to the first through hole, and the wind maintaining means for maintaining the state of hair wound around the rod with tension is a pin inserted through the first and second through holes.

According to yet another aspect of the present invention, a hair roller comprises a rod having a hair winding portion where at least a portion around which hair is wound is resiliently restitutively compressed and deformed and having a first slit piercing a longitudinal middle portion of the hair winding portion and further having a forked portion separated in two by a second slit piercing the hair winding portion, any one of the first slit and the forked portion being the hair distal end retaining means, and a wind maintaining means for maintaining the state of hair wound around the rod with tension.

DETAILED DESCRIPTION OF THE PREFERRED EMBODIMENTS

Hair rollers according to embodiments of the present invention will now be described based on the drawings. It is to be noted that the present invention is not limited thereto.

Embodiment 1

Figure 1A:
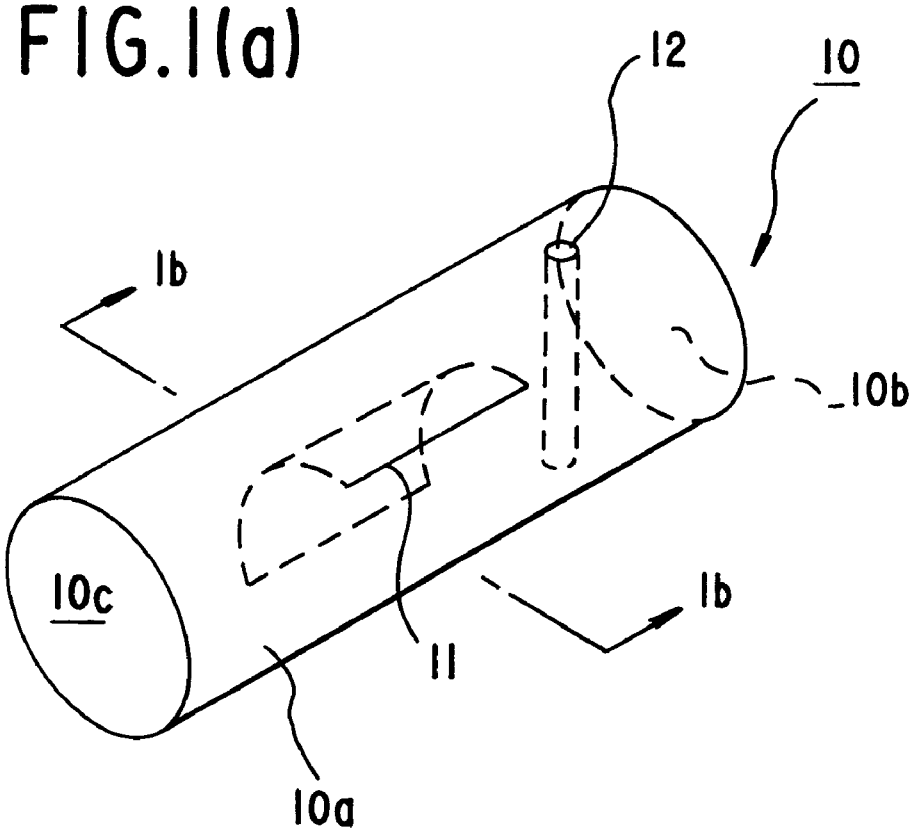
FIG. 1A is a schematic perspective view illustrating a rod of a hair roller according to a first embodiment of the present invention.
Figure 1B:
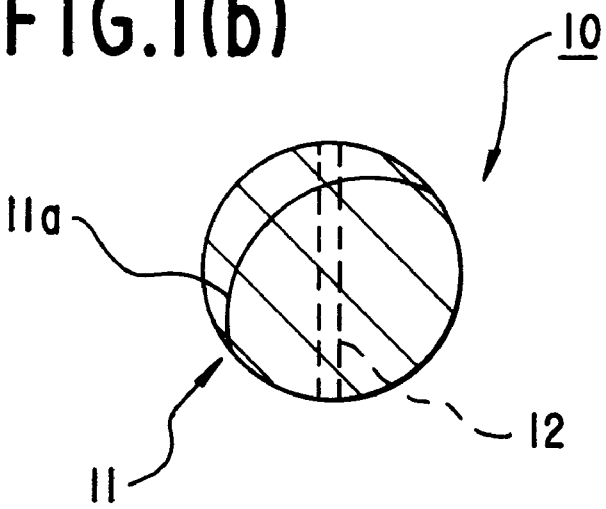
FIG. 1B is a section taken along the line A–A' in FIG. 1A.

FIG. 1A is a schematic perspective view illustrating a rod 1 of a hair roller according to Embodiment 1 of the present invention. For example, the rod 10 has a side surface 10*a* as a hair winding portion, a top surface 10*b*, and a bottom surface 10*c*, and is a cylindrical sponge-like body. A slit 11 for retaining hair is formed so as to pierce from one side surface portion to another side surface portion of the side surface 10*a* and so as to reach neither the top surface 10*b* nor the bottom surface 10*c* as a hair distal end retaining means for retaining distal ends 121 of hair. As shown in a schematic section of FIG. 1B, in a section taken along the line A–A' of the rod 10, the slit 11 for retaining hair is formed so as to draw an arc toward the center of the cylindrical sponge-like body, and its slit surface 11*a* is a curved surface. A through hole 12 from one side surface portion to another side surface portion of the side surface 10*a* is formed in the rod 10 such that a pin 13 or the like as a wind maintaining means can be inserted therein.

Figure 2A:
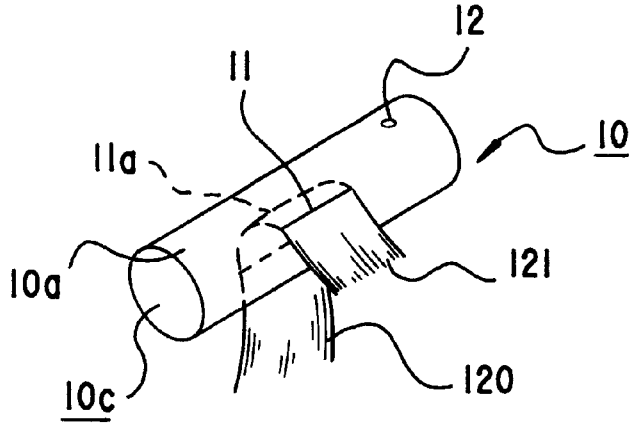
FIGS. 2A to 2D are schematic perspective views illustrating a method of winding hair onto the rod of the hair roller according to the first embodiment in the order of the processes.
Figure 2B:
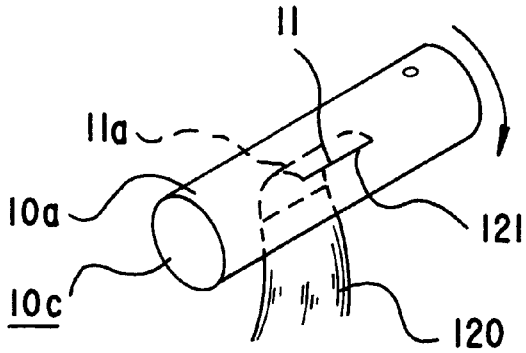
Figure 2C:
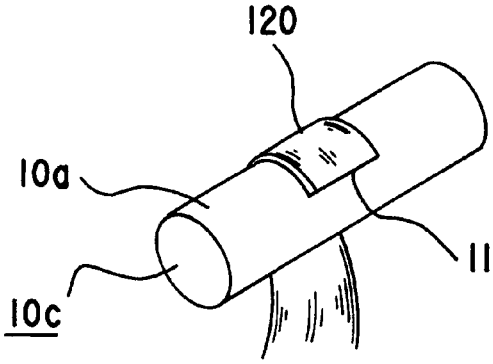
Figure 2D:
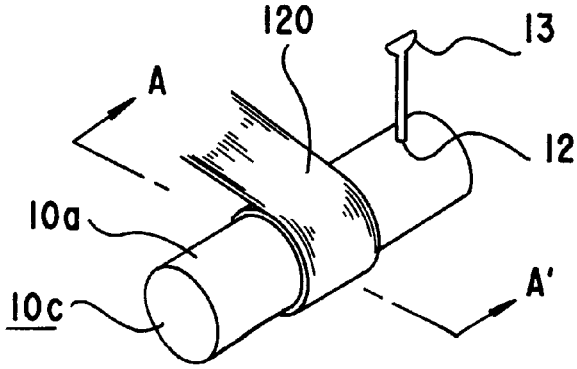

When hair 120 is wound around the rod 10 thus structured, as shown in FIG. 2, for example, the hair 120 is inserted through the slit 11 for retaining hair of the rod 10 (FIG. 2A), and after the distal ends 121 of hair are retained in the slit 11 for retaining hair (FIG. 2B), the rod 10 is rotated in a direction shown by an arrow in the figure to wind the hair 120 around it (FIG. 2C), and then, the pin 13 is inserted through the through hole 12 to prevent the rod 10 with the hair 120 wound around it from rotatably moving (FIG. 2D).

With the rod 10 described in the above, since the distal ends 121 of hair can be retained in advance in the slit 11 for retaining hair, and the slit 11 for retaining hair has a predetermined width and a predetermined depth, the distal ends 121 of hair can be prevented from being folded when the hair is wound, and, even if the length of the distal ends 121 of hair is uneven and varies, the distal ends 121 of hair can be easily retained in the slit 11 for retaining hair. Further, in case the process shown in FIG. 2B is performed by, after the hair 120 is once inserted through the slit 11 for retaining hair (the process shown in FIG. 2A), sliding the rod 10 in the direction of the distal ends 121 of hair, due to appropriate friction between the slit surface 11*a* of the slit 11 for retaining hair and the hair 120, the distal ends 121 of hair can be placed neatly with ease.

Figure 3:
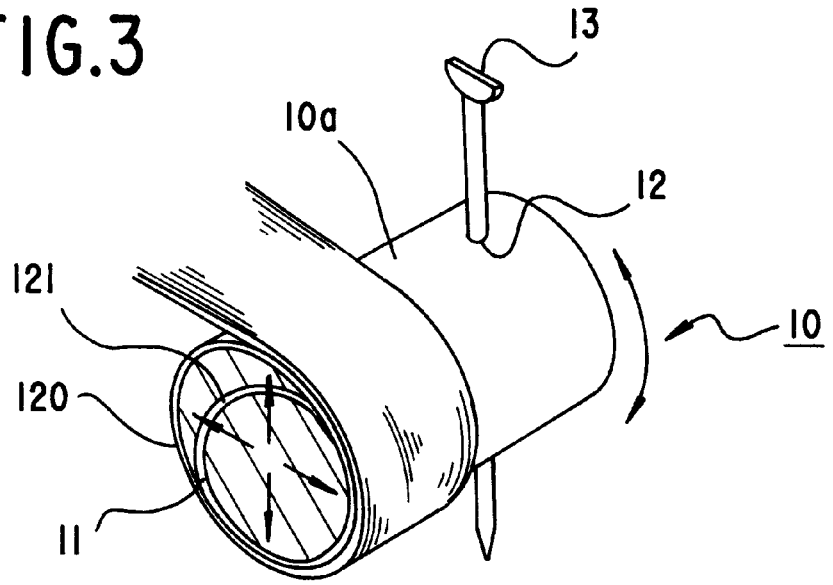
FIG. 3 is a schematic perspective view partially in section of the rod taken along the line A–A' in FIG. 2D.

FIG. 3 is an enlarged schematic perspective view partially in section taken along the line A–A' in FIG. 2D. As shown in the figure, the rod 10 is a sponge-like body. Since the sponge-like body is porous and the walls of the respective pores have shape restitutive force, the hair winding portion compressed when hair is wound around it is resiliently restitutively compressed and deformed. Therefore, tension toward the outside is always acting on the wound hair 120, which enables the hair to be curled more firmly and beautifully. In particular, if, after the distal ends 121 of hair are retained in the slit 11 for retaining hair, the hair 120 is wound with tension with the distal ends 121 of hair being firmly retained by pressing with fingers the slit 11 for retaining hair, the action of the tension can be emphasized more.

Further, if the pin 13 is inserted through the through hole 12, since rotational movement in two directions shown by arrows in the figure is limited, the state of the hair 120 wound around the rod 10 with tension is maintained.

Though the case where the though hole 12 is formed is shown in Embodiment 1, the present invention is not limited thereto, and even if the through hole 12 is not formed, by inserting the pin 13 or the like through the slit 11 for retaining hair, the rotational movement in the two directions shown by the arrows in the figure can be limited to maintain the wound state.

Embodiment 2

Figure 4:
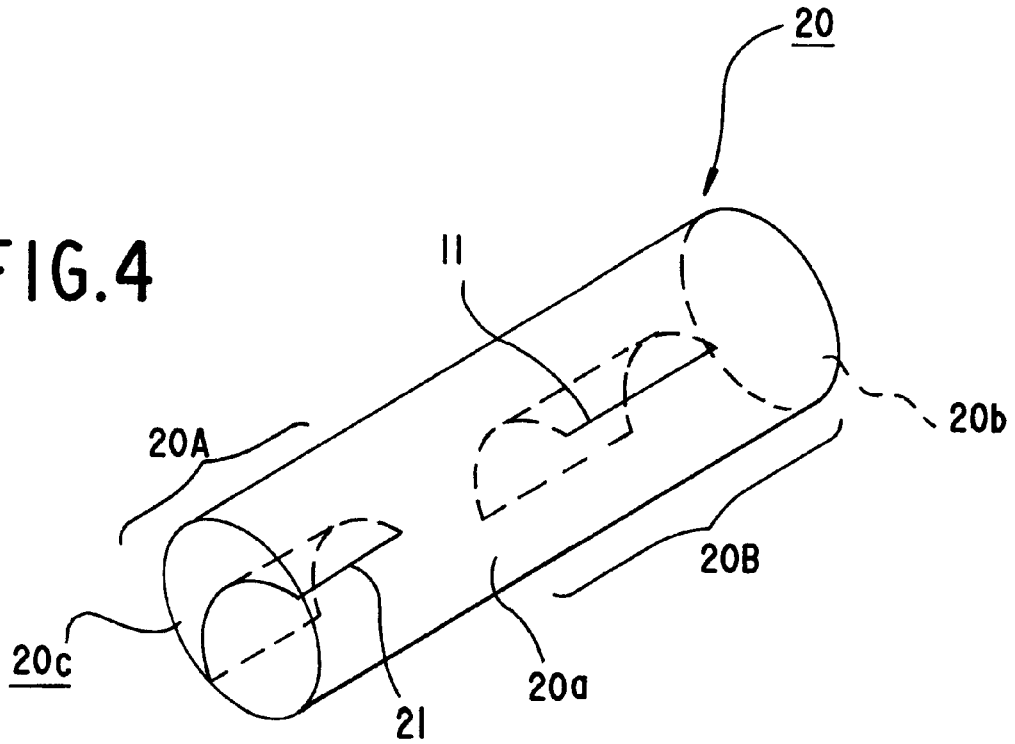
FIG. 4 is a schematic perspective view illustrating a rod of a hair roller according to a second embodiment of the present invention.

FIG. 4 is a schematic perspective view illustrating a rod 20 as a cylindrical sponge-like body of a hair roller according to Embodiment 2 of the present invention. In the rod 20, other than the slit (a first slit) 11 for retaining hair which pierces a longitudinal middle portion of a side surface 20*a* as a hair winding portion, a slit (a second slit) 21 for retaining hair which pierces from one side surface portion to another side surface portion of the side surface 20*a* and reaches a bottom surface 20*c* is formed. The slit 21 for retaining hair is also formed so as to, seen from the bottom surface of the rod 20, draw an arc toward the center of the cylindrical sponge-like body. Here, the rod 20 is formed of a forked portion 20A separated in two by the slit 21 for retaining hair, and a connected portion 20B other than the forked portion 20A. Any one of the slit 11 for retaining hair and the forked portion 20A is a hair distal end retaining means.

Figure 5A:
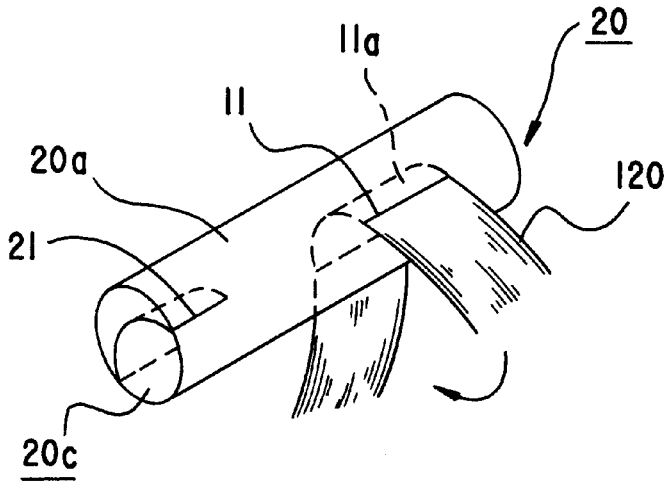
FIGS. 5A to 5C are schematic perspective views illustrating a method of winding hair onto the rod shown in FIG. 4 in the order of the processes.
Figure 5B:
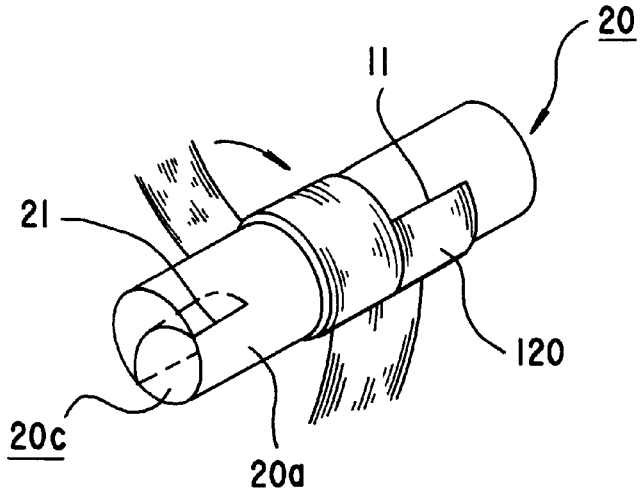
Figure 5C:
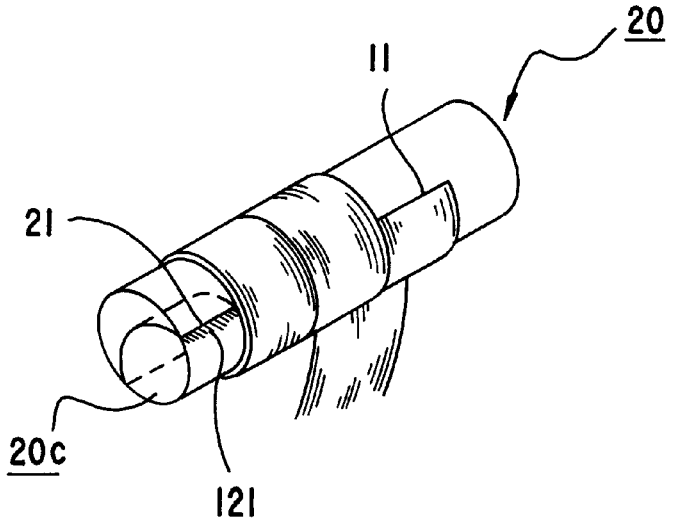

When the hair 120 is wound around the rod 20 thus structured, as shown in FIG. 5, the hair 120 is first inserted through the slit 11 for retaining hair. Here, for example, the hair 120 is inserted through up to the highest portion of the hair which is desired to be wound (FIG. 5A), the hair 120 is wound toward the slit 21 for retaining hair (FIG. 5B), and the end portion of the wound hair 120 is held in the slit 21 for retaining hair (FIG. 5C).

The rod 20 described in the above is, since, different from the case with the rod 10 shown in FIG. 1, the winding of hair begins from the highest portion of the hair which is desired to be wound, convenient in case, for example, the portion where the winding begins is desired to be curled firmly. Further, winding need not be to the distal ends 121 of hair and may be ended halfway. In this case, longitudinal middle portion of the hair 120 can be curled. Further, since the hair 120 is held by both of the slits 11 and 21 for retaining hair, the rod 20 can be prevented from rotatably moving, and, similar to the case of the rod 10 (FIG. 1), the pin 13 is not necessarily required to be used, and the through hole 12 (FIG. 1) may be formed but not necessary.

Figure 33:
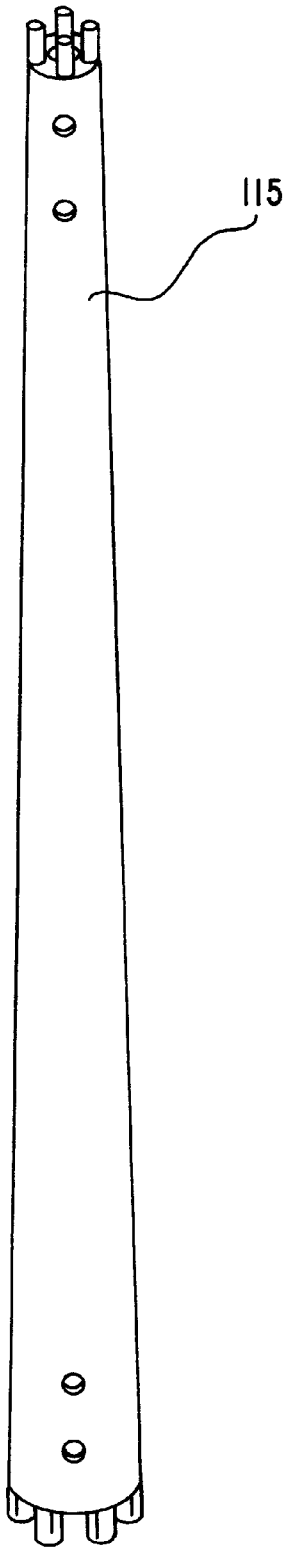
FIG.33 PRIOR ART
FIG. 33 is a schematic perspective view illustrating another conventional rod of a hair roller.

Here, for example, in case the rod 20 is sufficiently long, the rod 20 can be used instead of the conventional rod 115 (FIG. 33) for spirally winding hair around it to curl the hair. In this case also, since the beginning and the end of the wound hair 120 are held, the rod 20 can be prevented from rotatably moving.

Embodiment 3

Figure 6:
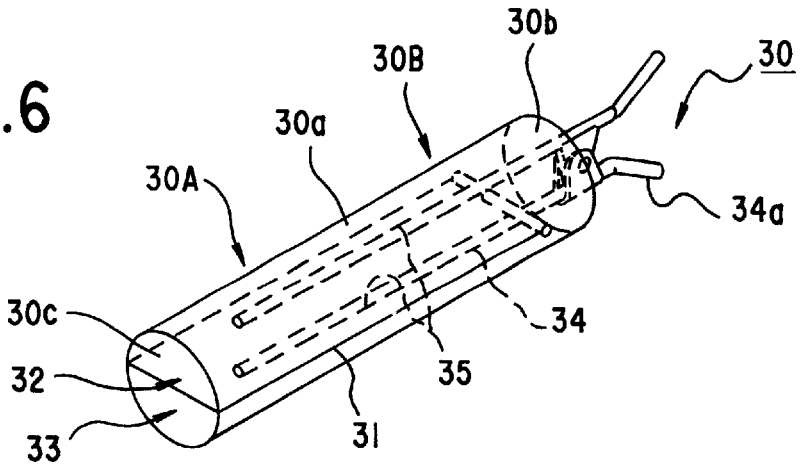
FIG. 6 is a schematic perspective view illustrating a rod of a hair roller according to a third embodiment of the present invention.

FIG. 6 is a schematic perspective view illustrating a rod 30 which is a cylindrical sponge-like body of a hair roller according to Embodiment 3 of the present invention. In the rod 30, a slit 31 for retaining hair which has a cut opening in a side surface 30*a* as a hair winding portion, pierces the side surface 30*a,* and reaches a bottom surface 30*c*. The rod 30 is formed of a forked portion 30A separated in two by the slit 31 for retaining hair, and a connected portion 30B other than the forked portion 30A. The forked portion 30A is a hair distal end retaining means. It goes without saying that, though a slit surface 31*a* of the slit 31 for retaining hair is a plane in the illustrated example, it may be a curved surface.

The forked portion 30A is formed of separated pieces 32 and 33. A hole 35 for inserting a clip or the like is formed substantially through the center of each of the separated pieces 32 and 33, and a clip 34 which is a wind maintaining means and which is opened and closed by a lever 34*a* is inserted in the holes 35.

Figure 7A:
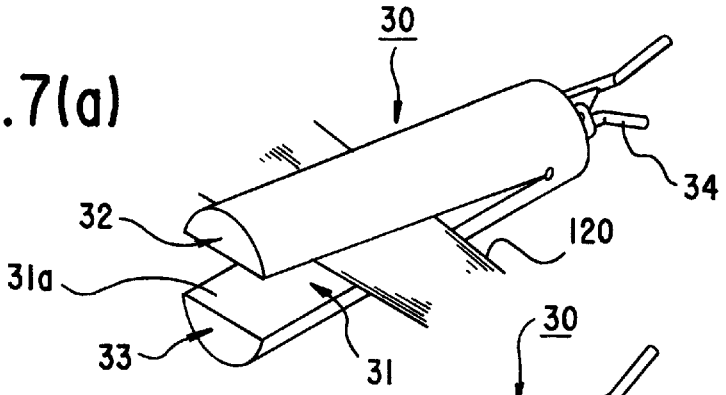
FIGS. 7A to 7C are schematic perspective views illustrating a method of winding hair onto the rod shown in FIG. 6 in the order of the processes.
Figure 7B:
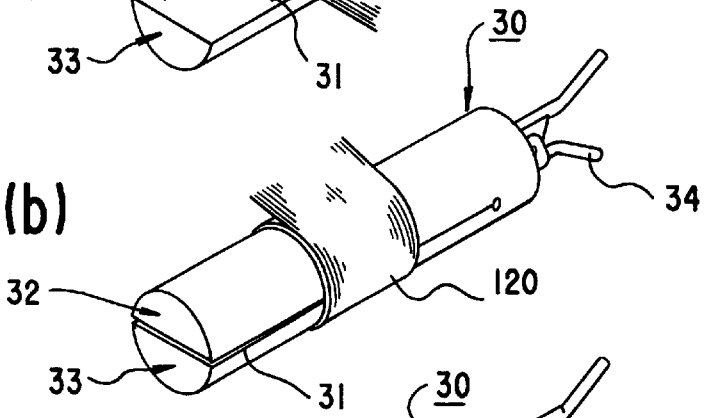
Figure 7C:
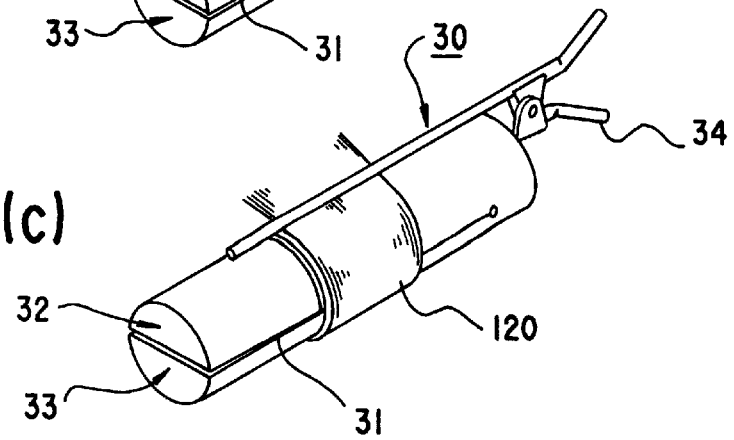

FIGS. 7A to 7C illustrate an example of a method of winding the hair 120 with the hair 120 sandwiched between the separated pieces 32 and 33 in the order of the processes. First, the clip 34 is inserted in the holes 35 for inserting a clip or the like, the lever 34*a* is operated to make a space between the separated pieces 32 and 33, and the hair 120 is inserted through the gap (FIG. 7A). Next, the lever 34*a* is released to allow the separated pieces 32 and 33 to sandwich the hair 120, and, by rotating the rod 30, for example, the side surface 30*a* of the rod 30 is made to wind the hair 120 around it (FIG. 7B). Then, the clip 34 is pulled out of the rod 30, one of the two parts of the clip 34 is inserted in one of the holes 35 for inserting a clip or the like, and the state of the hair 120 wound around the rod 30 with tension is maintained.

With the rod 30 described in the above, since the hair 120 is sandwiched between the separated pieces 32 and 33, there is no fair that the distal ends 121 of hair are folded. Further, since the winding can be carried out with the hair 120 firmly retained, the work is simpler compared with that of the conventional processes.

It is to be noted that, though the clip 34 is used in Embodiment 3, it goes without saying that the present invention is not limited thereto, and, depending on the situation, the holes 35 for inserting a clip or the like is not required to be formed. In this case, as described in the above, by inserting the pin 13 (FIG. 3) or the like through the slit 31 for retaining hair, the rotational movement of the rod 30 can be prevented.

Also, the holes 35 for inserting a clip or the like may be formed from the side of the forked portion 30A substantially through the center of each of the separated pieces 32 and 33.

Embodiment 4

Figure 8:
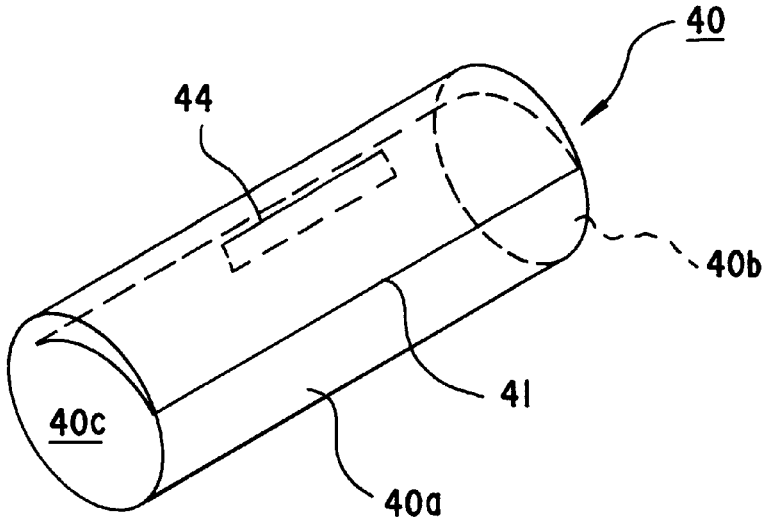
FIG. 8 is a schematic perspective view illustrating a rod of a hair roller according to a fourth embodiment of the present invention.

FIG. 8 is a schematic perspective view illustrating a rod 40 which is a cylindrical sponge-like body of a hair roller according to Embodiment 4 of the present invention. In the rod 40, a slit 41 for retaining hair which has a cut opening in a side surface 40*a* as a hair winding portion, does not pierce the side surface 40*a,* and reaches a top surface 40*b* and a bottom surface 40*c* is formed. The slit 41 for retaining hair is also formed so as to, seen from the bottom surface of the rod 40, draw an arc toward the center of the cylindrical sponge-like body, and its slit surface 41*a* is a curved surface. The rod 40 is formed of a turned-up piece 42 which can be turned up, and a rod body 43. A through hole 44 opened in the side surface 40*a* to the slit surface 41*a* is formed in the turned-up piece 42. In the rod 40, the slit 41 for retaining hair and the through hole 44 are together a hair distal end retaining means.

Figure 9A:
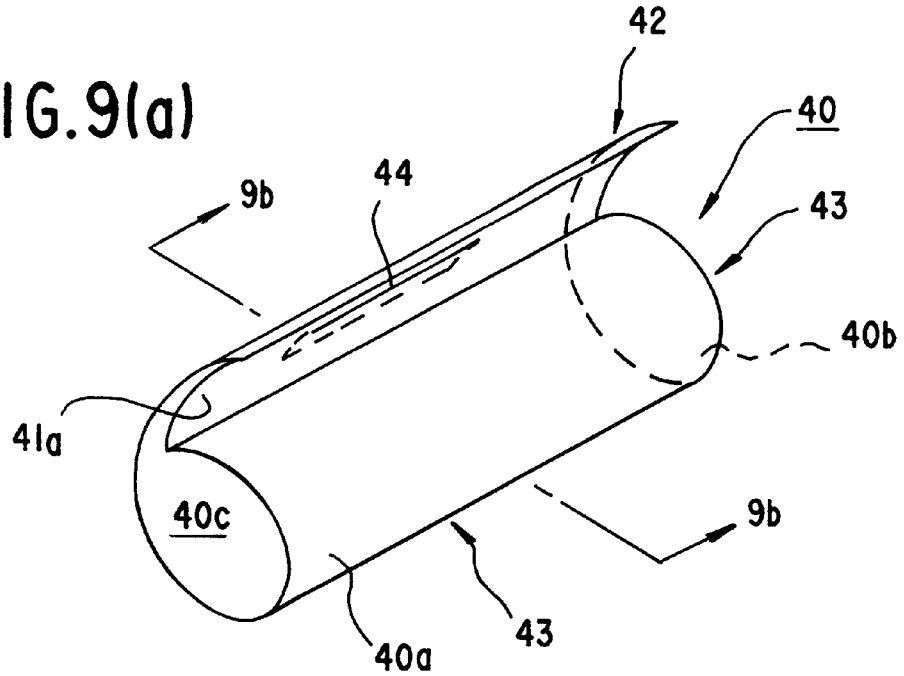
FIG. 9A is a schematic perspective view illustrating the rod shown in FIG. 8 with its slit surface being exposed.
Figure 9B:
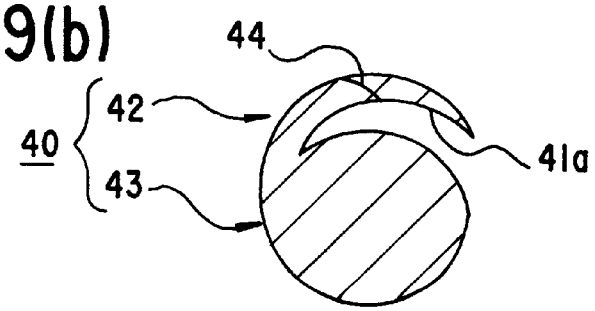
FIG. 9B is a section taken along the line A–A' in FIG. 9A.

FIG. 9A is a schematic perspective view illustrating the rod 40 with the turned-up piece 42 being lifted up and the slit surface 41*a* being exposed to the outside, and FIG. 9B is a section taken along the line A–A' in FIG. 9A. The more the through hole 44 becomes parallel with the slit surface 41*a,* the more smoothly the hair 120 is inserted through the through hole 44, and there is no fear that the distal ends 121 of hair are folded unnaturally, and thus, it is preferable.

Figure 10A:
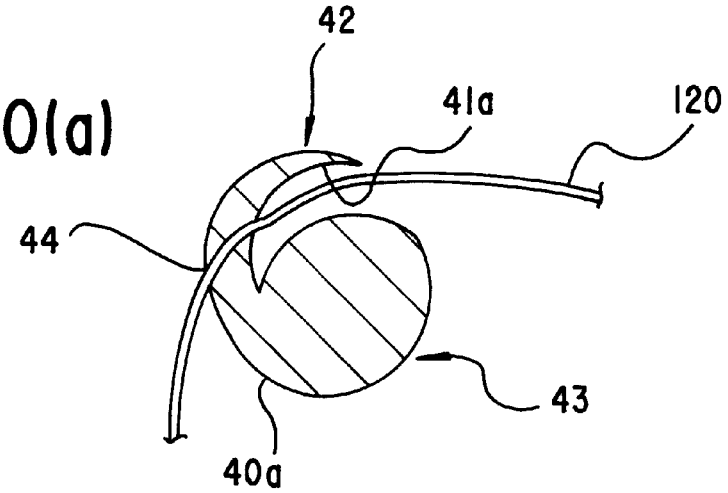
FIGS. 10A to 10C are schematic perspective views illustrating a method of winding hair onto the rod shown in FIG. 8 in the order of the processes.

When the hair 120 is wound onto the rod 40 thus structured, as shown in a schematic section of FIG. 10A, the turned-up piece 42 is lifted up from the rod body 43 and the hair 120 is inserted through the through hole 44 formed in the turned-up piece 42. Here, to insert the hair 120 from the side surface 40*a* to the slit surface 41*a* is operative. Next, as shown in a schematic section of FIG. 10B, by rotating the rod 40 in a direction shown by an arrow in the figure with the turned-up piece 42 closely adhering to the rod body 43, the distal ends 121 of hair are put in the slit 41 for retaining hair. By rotating the rod 40 in a direction shown by an arrow with the distal ends 121 of hair being retained, as shown in a schematic perspective view of FIG. 10C, the hair 120 is wound.

With the rod 40, since the hair 120 only has to be inserted through the through hole 44 formed in a relatively thin turned-up piece 42, the inserting work becomes easier. Further, pressing force from the side surface 40*a* of the turned-up piece 42 is easy to act on the distal ends 121 of hair after being inserted, and thus, the distal ends 121 of hair are retained firmly.

Figure 10B:
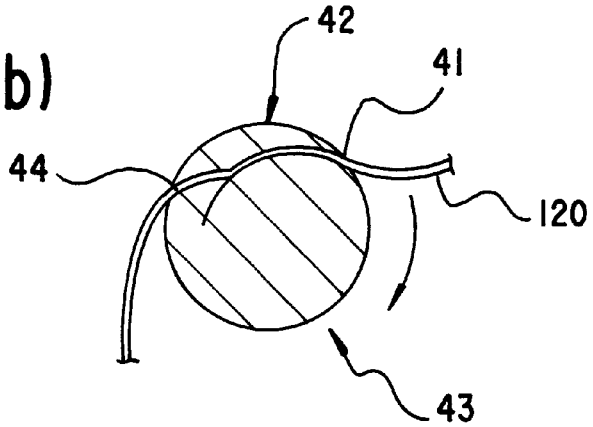
Figure 10C:
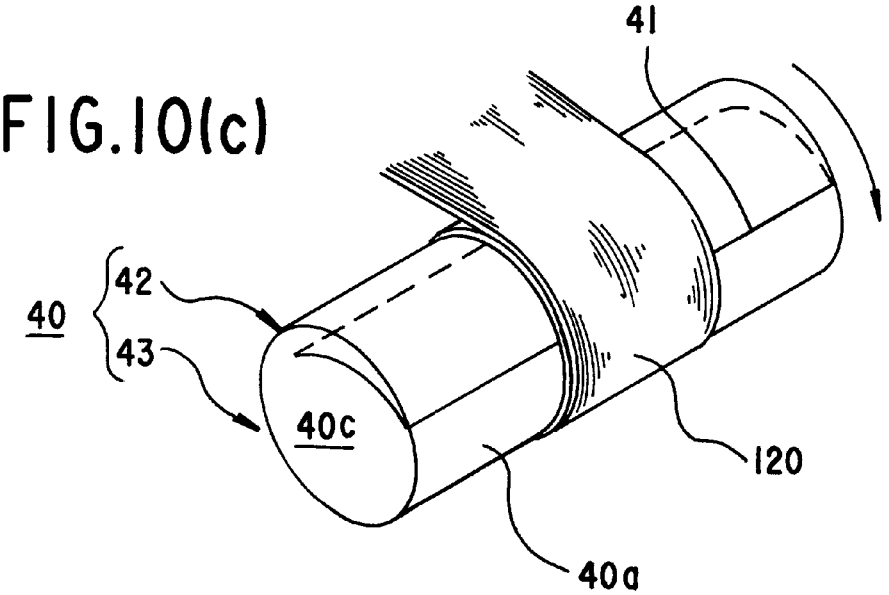
Figure 11:
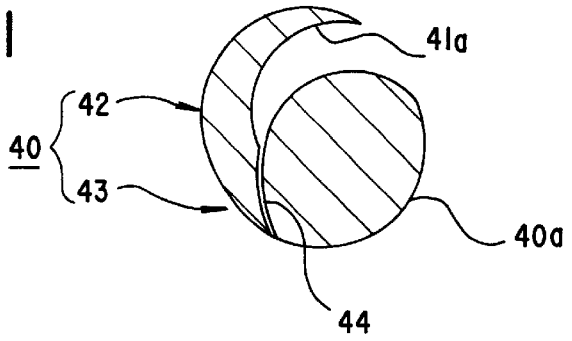
FIG. 11 is a schematic section for illustrating another example of the position where the through hole shown in FIG. 8 is to be formed.

It is to be noted that the place where the though hole 44 is formed is not limited to that shown in FIG. 10B, and the though hole 44 may be, for example, formed so as to extend to the side surface 40*a* from the boundary between the turned-up piece 42 and the rod body 43, as shown in FIG. 11.

Figure 12A:
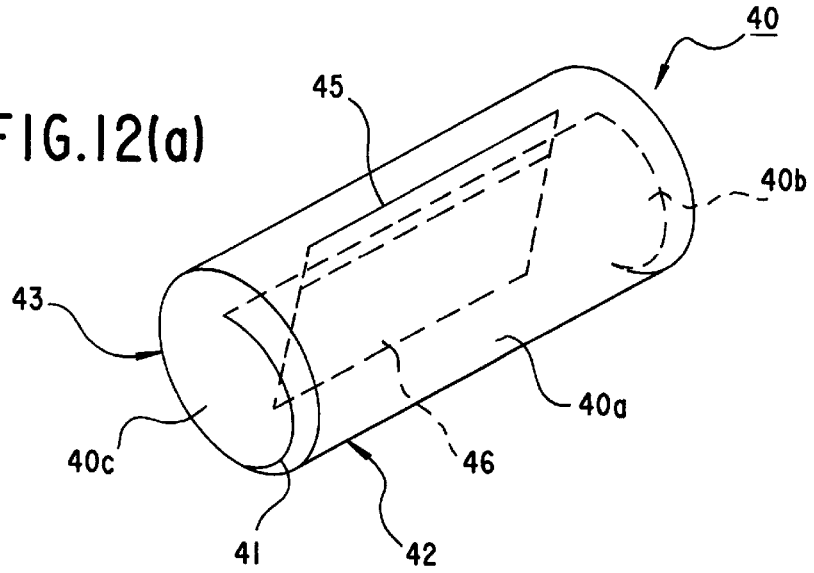
FIG. 12A is a schematic perspective view illustrating a rod of a hair roller according to a modification of the fourth embodiment.
Figure 12B:
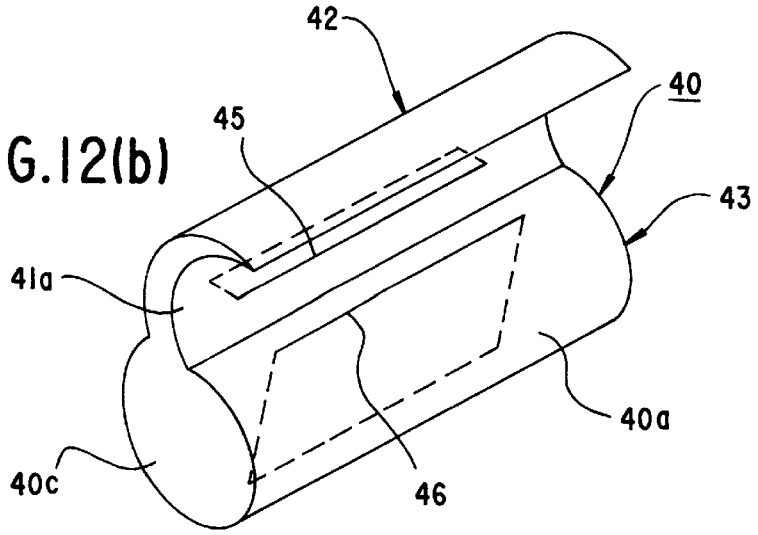
FIG. 12B is a schematic perspective view illustrating the rod with its slit surface being exposed.
Figure 13:
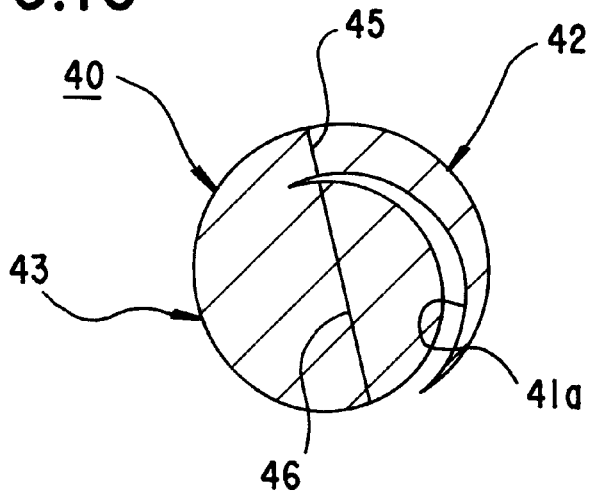
FIG. 13 is a section illustrating a portion including the through hole shown in FIG. 12.
Figure 14:
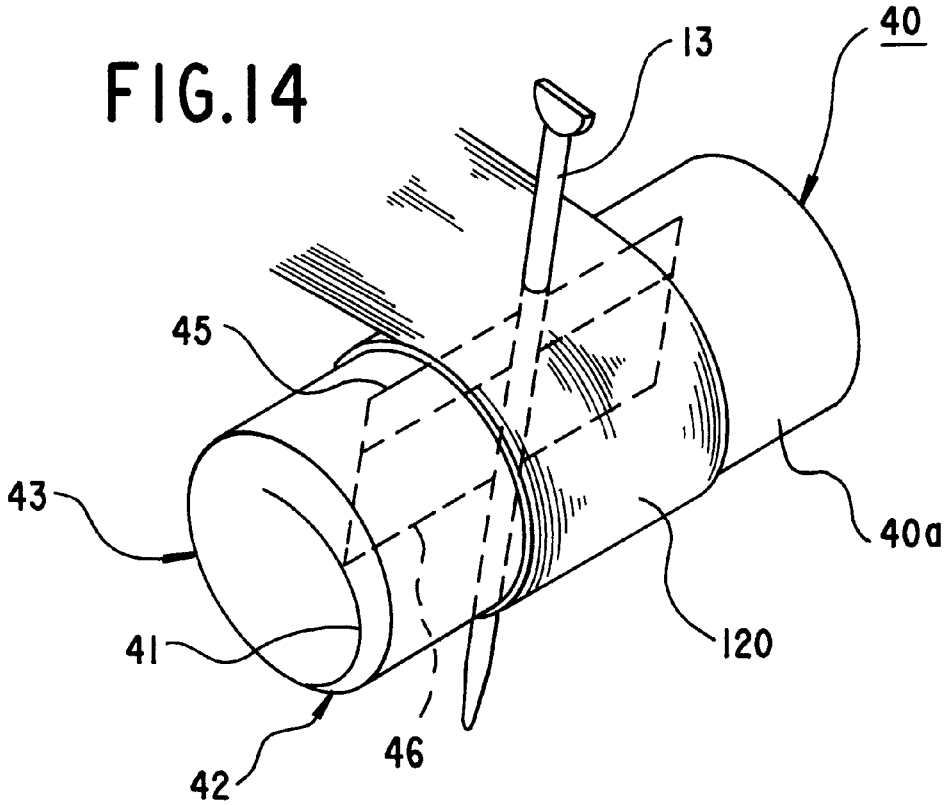
FIG. 14 is a schematic perspective view illustrating a wound state of hair around the rod shown in FIG. 12.

As a modification of Embodiment 4 described in the above, a hair roller shown in FIGS. 12 to 14 comprises a rod 40 having the slit 41 over the full length of the hair winding portion and formed so as not to pierce the hair winding portion and a first through hole 45 opened in a hair winding surface to the slit 41 together as the hair distal end retaining means, and also having a second through hole 46 formed in the rod body 43 so as to lead to the first through hole 45, and a wind maintaining means for maintaining the state of the hair 120 wound around the rod 40 with tension as the pin 13 which is inserted through the first and second through holes 45 and 46. More specifically, in the rod 40, the slit 41 for retaining hair which has a cut opening in the side surface 40*a* as the hair winding portion, does not pierce the side surface 40*a,* and reaches the top surface 40*b* and the bottom surface 40*c* is formed. The first through hole 45 and the second through hole 46 are formed in a base portion of the turned-up piece 42 and in a diameter portion of the rod body 43, respectively, so as to be in a line.

The way to use the hair roller is illustrated in FIG. 14. Similar to the case of Embodiment 4, the distal ends 121 of the hair 120 are inserted through the first through hole 45 in the turned-up piece 42 from the inside to the outside, and the hair 120 is wound around the rod 40 with tension. After that, the commercially available pin 13 is inserted through the first and second through holes 45 and 46 to maintain the state of the hair 120 wound around the rod 40 so as not to be loosened.

Embodiment 5

Figure 15A:
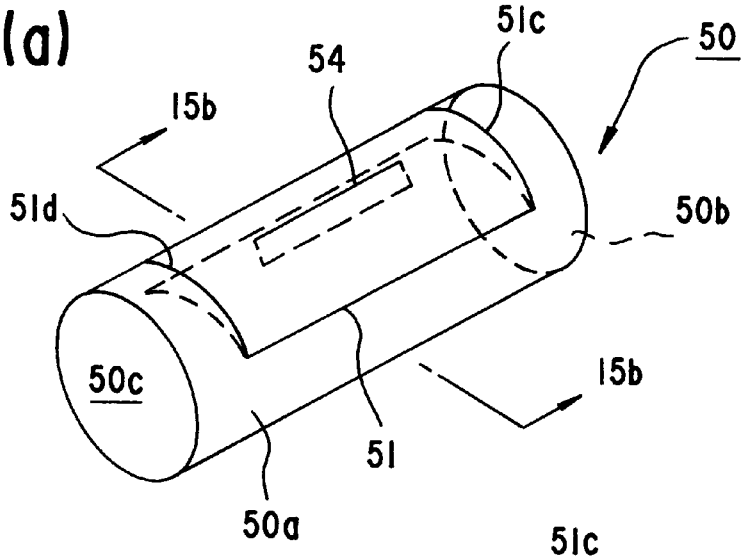
FIG. 15A is a schematic perspective view illustrating a rod of a hair roller according to a fifth embodiment of the present invention.
Figure 15B:
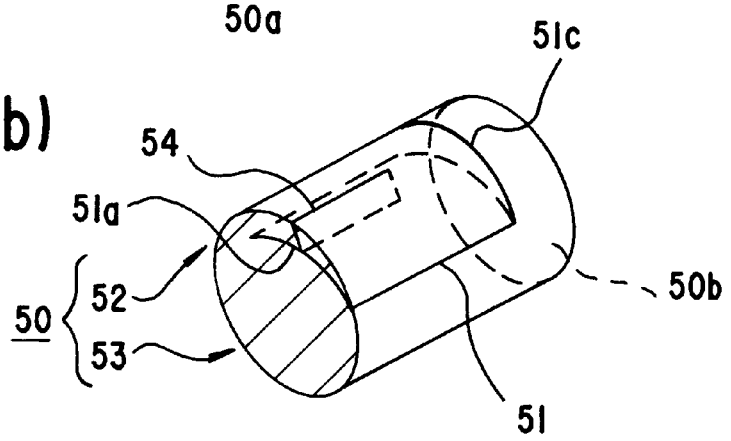
FIG. 15B is a schematic perspective view partially in section of the rod.

FIG. 15A is a schematic perspective view illustrating a rod which is a cylindrical sponge-like body of a hair roller according to Embodiment 5 of the present invention, and FIG. 15B is a schematic perspective view partially in section of the rod taken along the line A–A'. In the rod 50 shown in the figure, a slit 51 for retaining hair which has a cut opening in a side surface 50*a* as a hair winding portion, does not pierce the side surface 50*a,* and reaches neither a top surface 50*b* nor a bottom surface 50*c* is formed. The slit 51 for retaining hair is also formed so as to, seen from the bottom surface of the rod 50, draw an arc, and a slit surface 51*a* formed by the slit 51 for retaining hair is a curved surface. Let a portion of the rod which can be turned up by the slit 51 for retaining hair and by auxiliary slits 51*c* and 51*d* formed substantially perpendicular to the slit 51 be a turned-up piece 52, and the portion other than the turned-up piece 52 be a rod body 53. A through hole 54 opened in the side surface 50*a* to the slit surface 51*a* is formed somewhere in the turned-up piece 52. In the rod 50, both of the slit 51 for retaining hair and the though hole 54 are a hair distal end retaining means.

Figure 16:
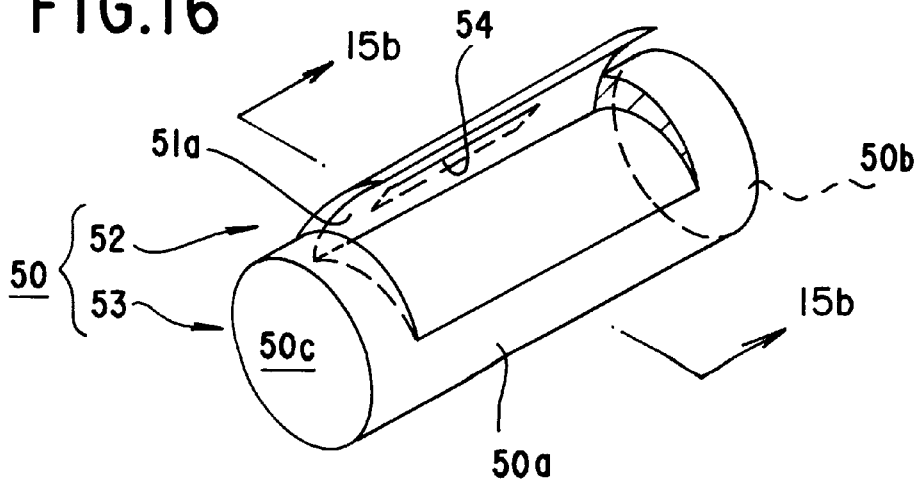
FIG. 16 is a schematic perspective view illustrating the rod shown in FIG. 15 with its slit surface being exposed.

FIG. 16 is a schematic perspective view illustrating the rod 50 with the turned-up piece 52 being lifted up and the slit surface 51*a* being exposed. Also in a section taken along the line A–A' in the figure, the more the through hole 54 becomes parallel with the slit surface 51*a,* the more smoothly the hair 120 is inserted through the through hole 54, and there is no fear that the distal ends 121 of hair are folded unnaturally, and thus, it is preferable.

A method of winding hair onto the rod 50 is similar to that with regard to the rod 40.

It is to be noted that, in this case also, similar to the case of the modification of Embodiment 4, a first through hole and a second through hole may be formed in the turned-up piece 52 and the rod body 53, respectively.

There is no limitation with regard to the sponge-like body of the rods 10 to 50, so far as it has water retentivity, and is highly flexible and resilient. The material may be synthetic foam made of polymer such as polyurethane, sponge rubber made by foaming rubber with foaming agent, or the like. Further, in case of the rod 40 or rod 50 with the turned-up piece 42 or 52, the spongelike body of the turned-up piece 42 or 52 may have properties different from those of the sponge-like body of the rod body 43 or 53. For example, it can be easily implemented to use a somewhat soft sponge-like body as the turned-up piece 42 or 52 and use a somewhat hard sponge-like body as the rod body 43 or 53 to make the rod easy to turn up, and at the same time, easy to wind hair around it. Even in this case, the turned-up piece 42 or 52 is preferably formed integrally with the rod body 43 or 53. It is to be noted that it goes without saying that a rod according to the present invention is not limited to the sponge-like bodies described in the above, and may be anything so far as it has a hair winding portion where at least a portion around which hair is wound is resiliently restitutively compressed and deformed.

Figure 17A:
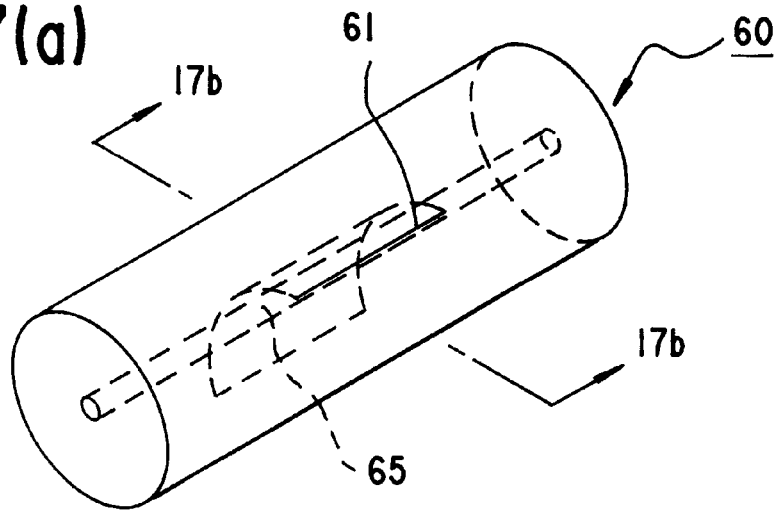
FIG. 17A is a schematic perspective view illustrating a rod of a hair roller according to a sixth embodiment of the present invention.
Figure 17B:
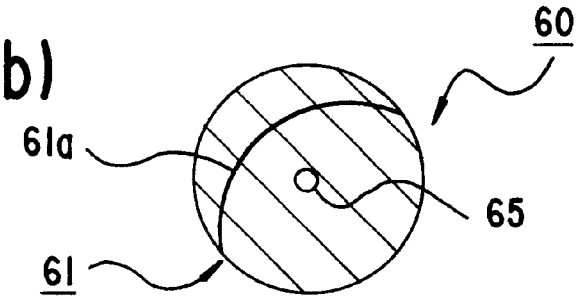
FIG. 17B is a section taken along the line A–A' in FIG. 17A.

FIG. 17A is a schematic perspective view illustrating a rod 60 which is a cylindrical sponge-like body of a hair roller according to Embodiment 6 of the present invention. As illustrated in the figure, the center of the rod 60 is a cavity 65, and a slit 61 for retaining hair which pierces a side surface 60*a* as a hair winding portion and reaches neither a top surface 60*b* nor a bottom surface 60*c* is formed as a hair retaining means. In a section taken along the line A to A' across the slit 61 for retaining hair, as shown in a schematic section of FIG. 17B, the slit 61 for retaining hair is formed so as to draw an arc, and a slit surface 61a formed by the slit 61 for retaining hair is a curved surface.

Embodiment 7

Figure 18:
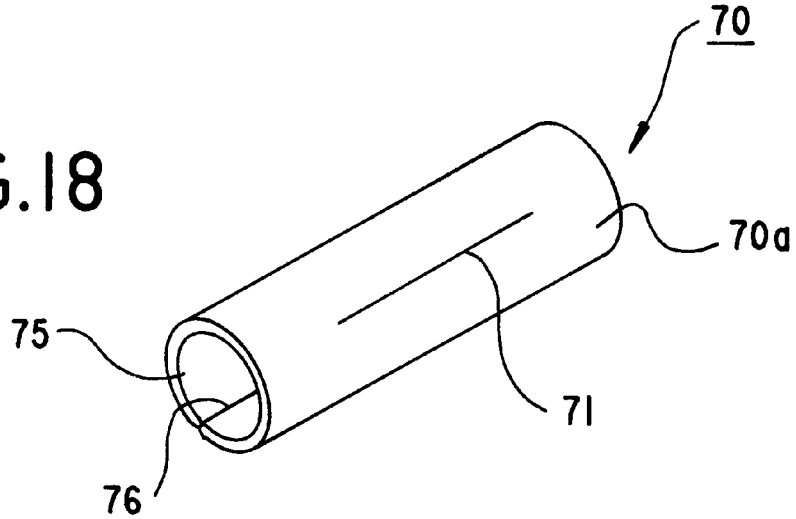
FIG. 18 is a schematic perspective view illustrating a rod of a hair roller according to a seventh embodiment of the present invention.

FIG. 18 is a schematic perspective view illustrating a substantially cylindrical rod 70 for describing a hair roller according to Embodiment 7 of the present invention. As illustrated in the figure, the center of the rod 70 is a cavity 75, and a first slit 76 is formed over the full length of a side surface 70*a* as a hairwinding portion. The rod 70 is made of, for example, synthetic resin such as plastic, and the hair winding portion is resiliently restitutively compressed and deformed due to the formed first slit 76. Further, a slit 71 (a second slit) for retaining hair which is formed in a longitudinal middle portion of the rod 70 and leads to the cavity 75 is formed in the side surface 70*a*.

Figure 19A:
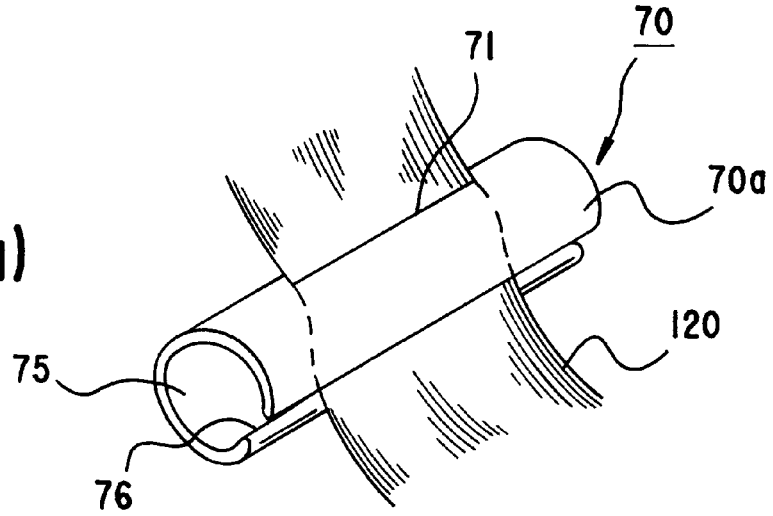
FIGS. 19A to 19C are schematic perspective views illustrating a method of winding hair onto the rod shown in FIG. 18 in the order of the processes.
Figure 19B:
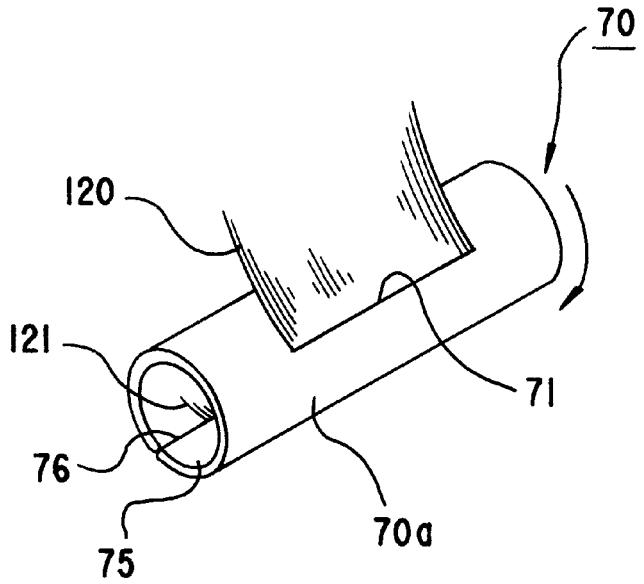
Figure 19C:
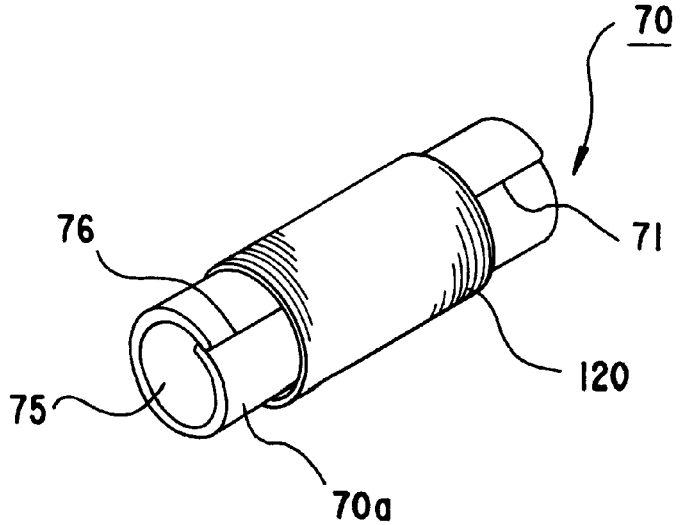

When the hair 120 is wound onto the rod 70, as shown in FIG. 19, first of all, the hair 120 is drawn out to the outside through the slit 71 for inserting hair and the first slit 76 (FIG. 19A), the rod 70 is rotated in a direction shown by an arrow in the figure with the distal ends 121 of hair retained in the cavity 75 (FIG. 19B), and the state shown in FIG. 19C is obtained.

The material of the rod 70 is not limited and may be anything so far as its hair winding portion is resiliently restitutively compressed and deformed due to the existence of the first slit 76, and may be a sponge-like body, silicone, plastic, or the like. Further, it may be a shape memory member.

Figure 20A:
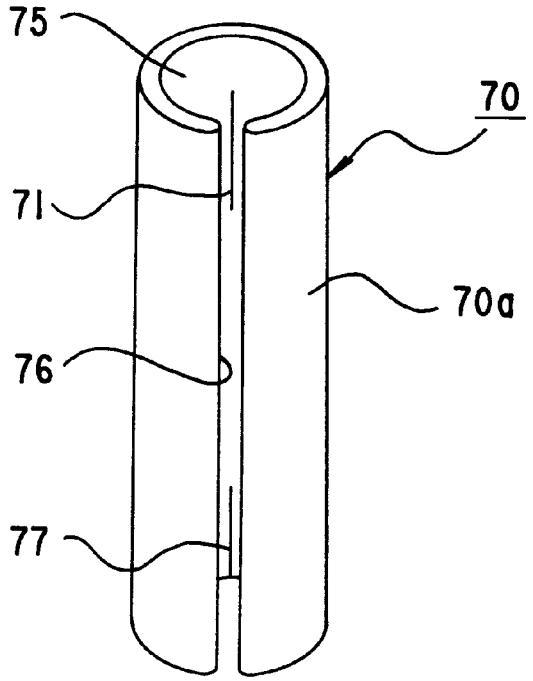
FIG. 20A is a schematic perspective view illustrating a rod of a hair roller according to a modification of the seventh embodiment seen from the side of a first slit.
Figure 20B:
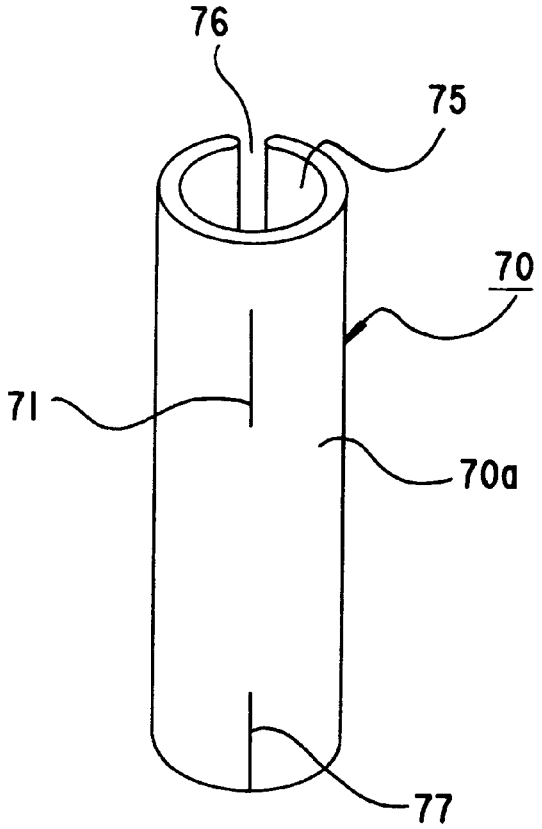
FIG. 20B is a schematic perspective view seen from the rear side of FIG. 20A.
Figure 21:
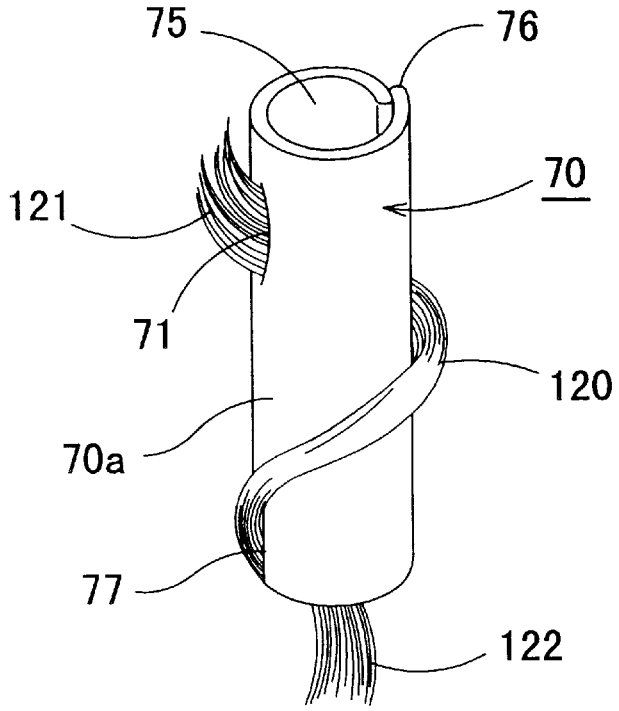
FIG. 21 is a schematic perspective view illustrating a wound state of hair around the rod shown in FIG. 20.
Figure 22:
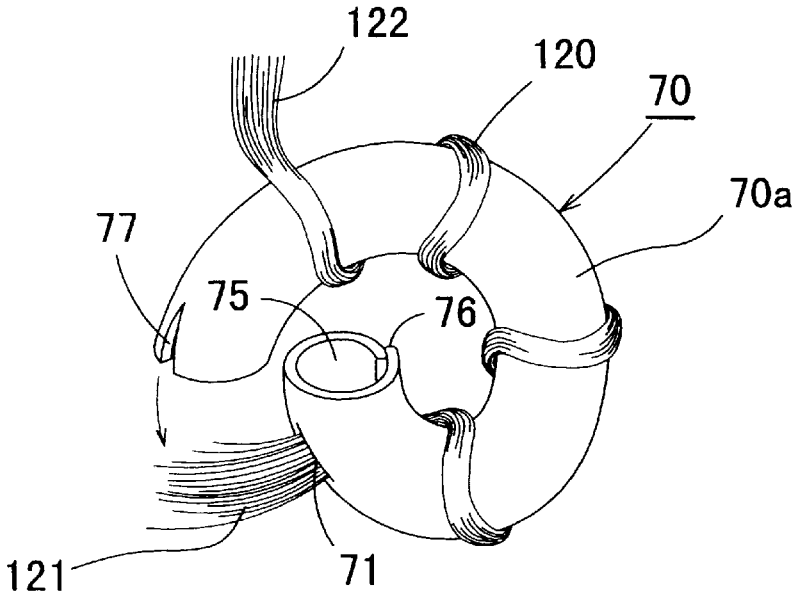
FIG. 22 is a schematic perspective view illustrating another wound state of hair around the rod shown in FIG. 20.

A hair roller shown in FIGS. 20 to 22 as a modification of Embodiment 7 described above further has a third slit 77 formed at one end portion of the rod 70. Also in this case, the distal ends 121 of the hair 120 are inserted through the slit 71 for inserting hair to be retained, the hair 120 is drawn out to a hair winding surface of the rod 70 through the first slit 76, and after the hair 120 is wound onto the rod 70 with tension, the proximal side 122 of the hair 120 is put in the third slit 77 to maintain the wound state (see FIG. 21), or, the rod 70 is bent like a ring with the hair 120 being wound and put the distal ends 121 of the hair 120 in the third slit 77 to maintain the wound state (see FIG. 22).

Embodiment 8

Figure 23:
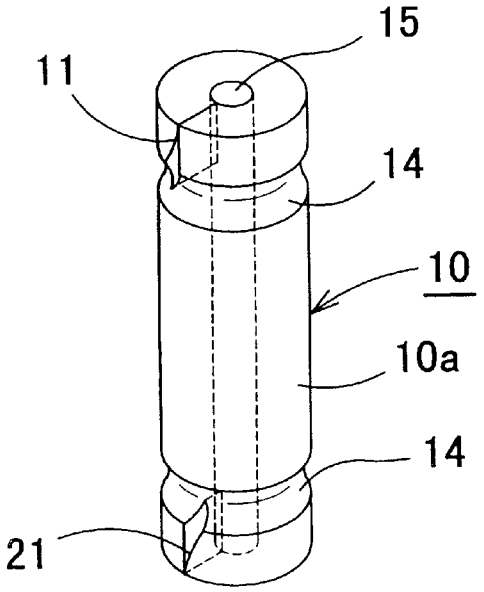
FIG. 23 is a schematic perspective view illustrating a rod of a hair roller according to an eighth embodiment of the present invention.
Figure 24:
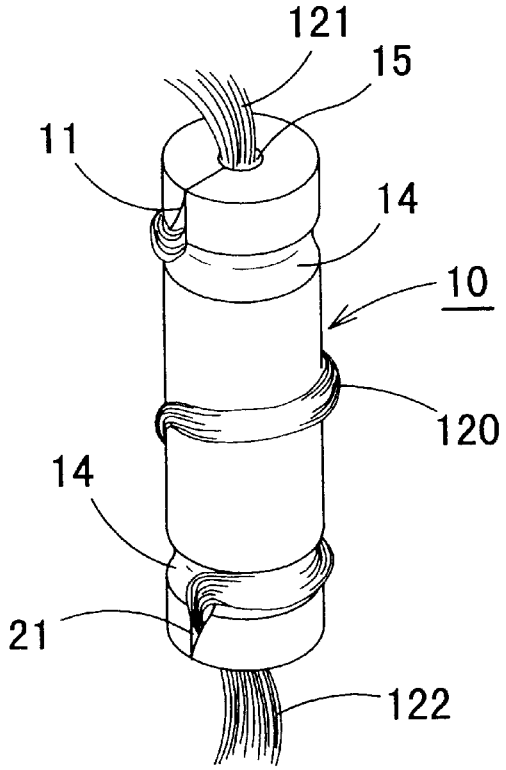
FIG. 24 is a schematic perspective view illustrating a wound state of hair around the rod shown in FIG. 23.

FIGS. 23 and 24 illustrate a hair roller according to Embodiment 8 of the present invention. The present embodiment corresponds to a modification of Embodiment 1 and Embodiment 2 described in the above. The slit 11 for retaining hair is formed at one end portion of the rod 10 formed of a sponge-like body, and the slit 21 for retaining hair is formed at the other end portion of the rod 10. After the distal ends 121 of the hair 120 are put in the one slit 11 for retaining hair and the hair 120 is wound onto the rod 10 with tension, the proximal side 122 of the hair 120 is put in the other slit 21 for retaining hair to maintain the wound state. Accordingly, the one slit 11 for retaining hair is the hair distal end retaining means while the other slit 21 for retaining hair is the wind maintaining means. Here, the slit 11 for retaining hair and the slit 21 for retaining hair may be formed so as to pierce the rod 10, and may be formed so as not to pierce the rod 10.

Further, annular grooves 14 are formed at both end portions of the rod 10 with some margins from the ends, respectively. The slit 11 for retaining hair and the slit 21 for retaining hair lead to the annular grooves 14, respectively. Similar to the cases described in the above, it is preferable to form a cavity 15 in the center of the rod 10. Since the cavity 15 can receive the distal ends 121 and the proximal side 122 of the hair 120, the wound state can be maintained with further stability.

Figure 25:
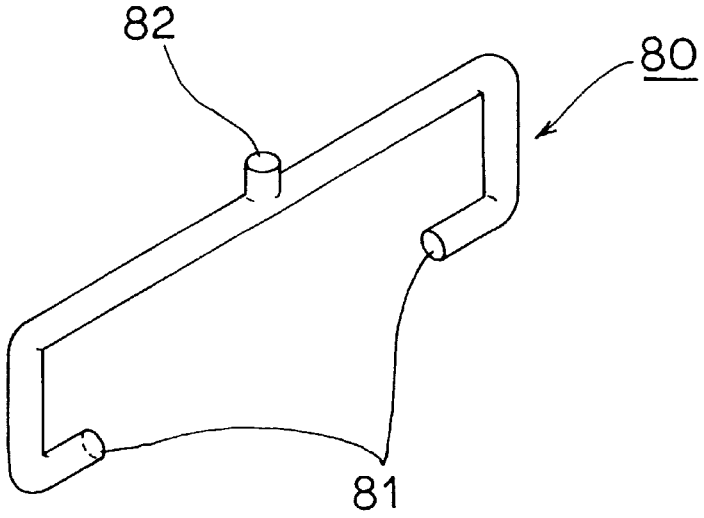
FIG. 25 is a schematic perspective view illustrating a tube-like body as the wind maintaining means B for use in an embodiment of the present invention.

A tube like body illustrated in FIG. 25 may be attached to the cavity 65, 75, or 15 of the rod 60, 70, 10 in Embodiment 6, 7, or 8 described in the above as a wind maintaining means (a wind maintaining means B). A tube-like body 80 shown in the figure is substantially U-shaped such that both end portions 81 are bent to face each other. The both end portions 81 can be, for example, fit into the cavity 65. from the sides of the top surface 60*b* and the bottom surface 60*c* of the rod 60. The fitting may be carried out utilizing either deformability of the rod 60 or 70, or flexibility of the tube-like body. A hole 82 is formed in a middle portion of the tube-like body 80. When the hole 82 is an inlet, the both end portions 81 are outlets. The material of the tube-like body 80 may be, for example, plastic, metal, or the like, and preferably, has appropriate characteristics according to the state of its usage, for example, chemical resistance or heat resistance.

Figure 26:
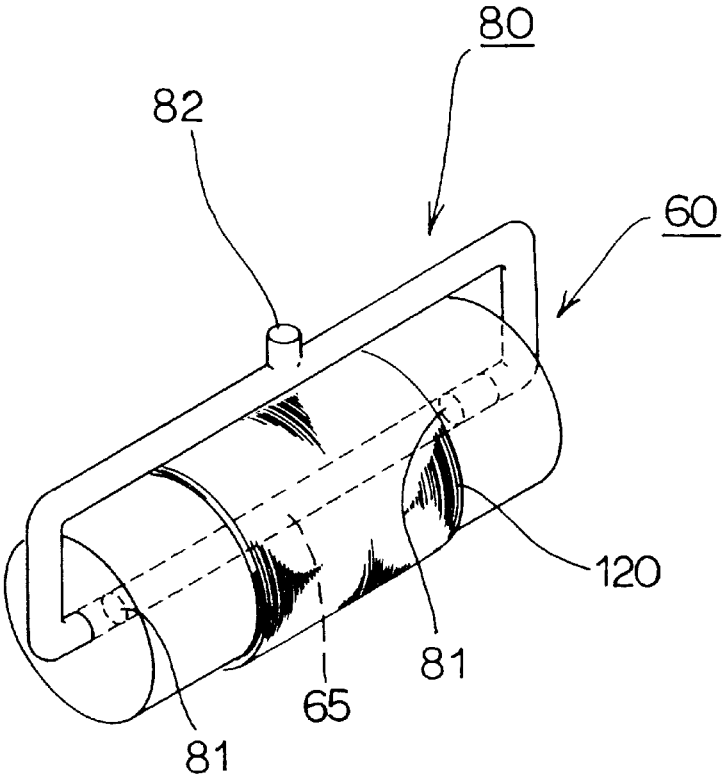
FIG. 26 is a schematic perspective view illustrating a hair roller formed as a combination of the rod shown in FIG. 17 and the tube-like body shown in FIG. 25.

FIG. 26 illustrates the rod 60 with the tube-like body 80 provided so as to press the rod 60. The hair 120 has already been wound around the rod 60. With this state maintained, in case gas or liquid is applied from the hole 82 of the tube-like body 80, the liquid or the like moves in the tube-like body 80 to fill the cavity 65 of the rod 60 from the both end portions 81. Since the rod 60 is a sponge-like body or the like, the liquid or the like in the cavity 65 permeates the rod 60. In particular, in case the sponge-like body is compressed by crumpling up the sponge-like body with a hand or the like, due to the nature of the sponge-like body, it sufficiently absorbs the liquid or the like when its shape is restored. The liquid or the like is to be applied to the hair 120 wound onto the rod 60.

It is to be noted that the tube-like body 80 can be applied not only to the rod 60 or 70 of Embodiment 6 or 7 but also to the rod 10, 20, 40, or 50 of Embodiment 1, 2, 3, 4, or 5.

In this way, in case the tube-like body 80 is provided so as to press the rod 60, the liquid or the like can be applied from the inside of the rod 60. Further, the application is made with the hair in a wound state. For example, in case a perming liquid is used as the liquid, the perming liquid can be applied after the hair is wound, while, conventionally, the winding work is carried out after the perming liquid is applied to the hair. Further, in this case, since the perming liquid permeates the wound hair from the inside, at the time when the liquid is applied to the surface of the wound hair, the liquid has permeated sufficiently. Accordingly, the hair can be permed more certainly and beautifully compared with a conventional case. Further, by sandwiching the wound hair 120 between the rod 60 and the tube-like body 80, the rod 60 can be prevented from rotatably moving.

Figure 27:
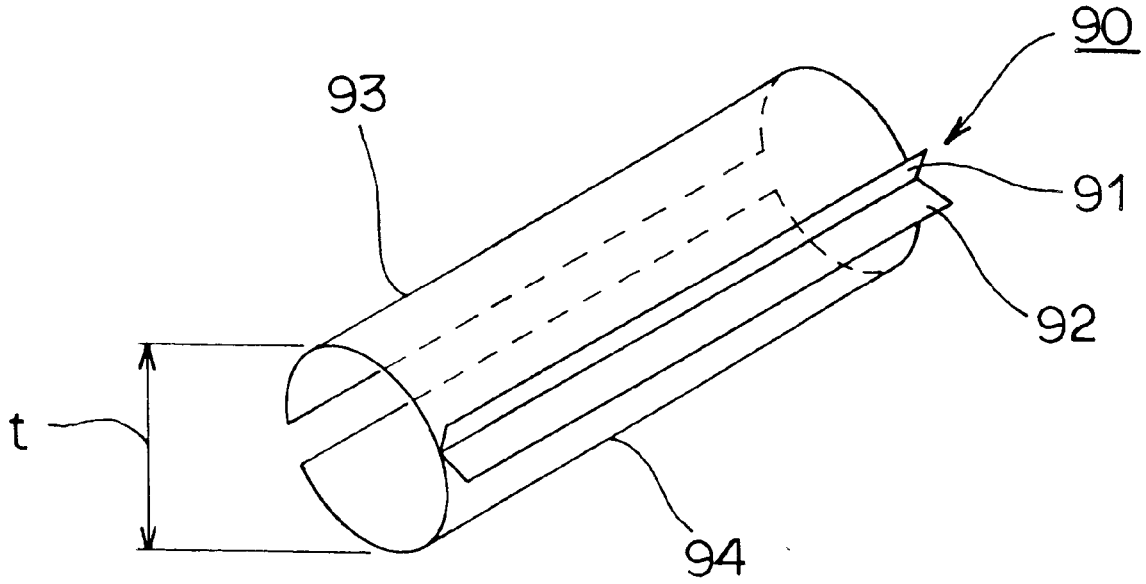
FIG. 27 is a schematic perspective view illustrating a covering body as the wind maintaining means A for use in an embodiment of the present invention.

In case the hair is wound onto the rod 10, . . . or 70, by holding or fastening the rod with a covering body described in the following, the state of the hair 120 wound around the rod 10, . . . or 70 with tension can be maintained. FIG. 27 is a schematic perspective view illustrating an example of the covering body as a wind maintaining means (wind maintaining means A). In the figure, a covering body 90 comprises levers 91 and 92 with their axis being in parallel with the central axis of the rod 10, . . . , or 70 when the covering body 90 holds the rod 10, . . . , or 70, and covering pieces 93 and 94 which are opened and closed by the levers 91 and 92 and lead to the levers 91 and 92, respectively. Because the covering pieces 93 and 94 are to hold or fasten the rod 10, . . . , or 70, the distance between the covering pieces 93 and 94 is preferably an opening distance t with which the state of the hair 120 wound around the rod 10, . . . , or 70 with tension can be maintained by pressing by inner surfaces of the covering pieces 93 and 94 when the covering pieces are closed.

In order to have good breathability, the covering body 90 is preferably made of porous material or is mesh-like. For example, the covering body 90 may be formed of a plastic material with good chemical resistance and good heat resistance.

Figure 28A:
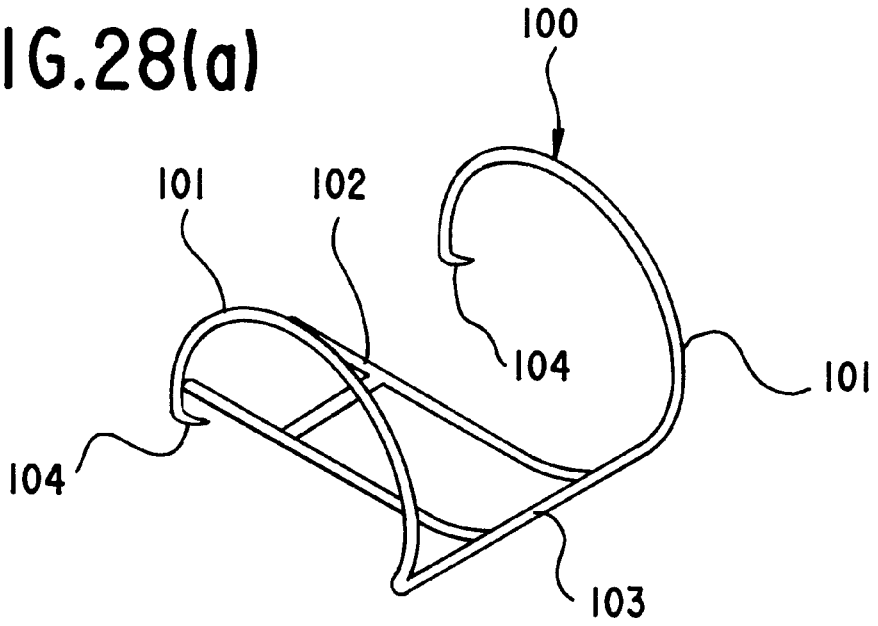
FIG. 28 is a schematic perspective view illustrating a stopper as the wind maintaining means C for use in an embodiment of the present invention.
Figure 28B:
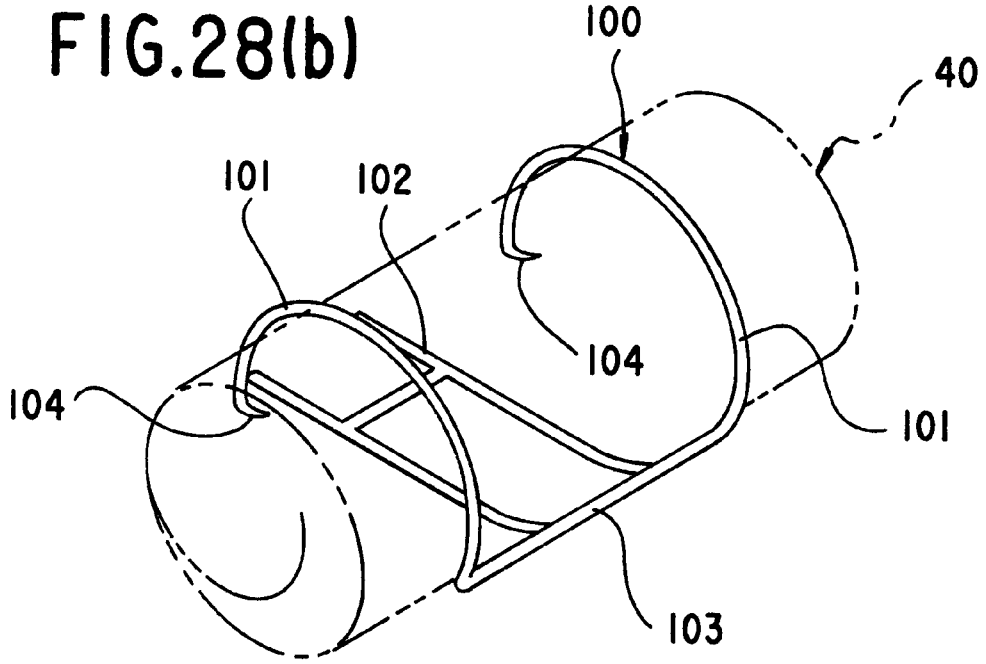
Figure 29A:
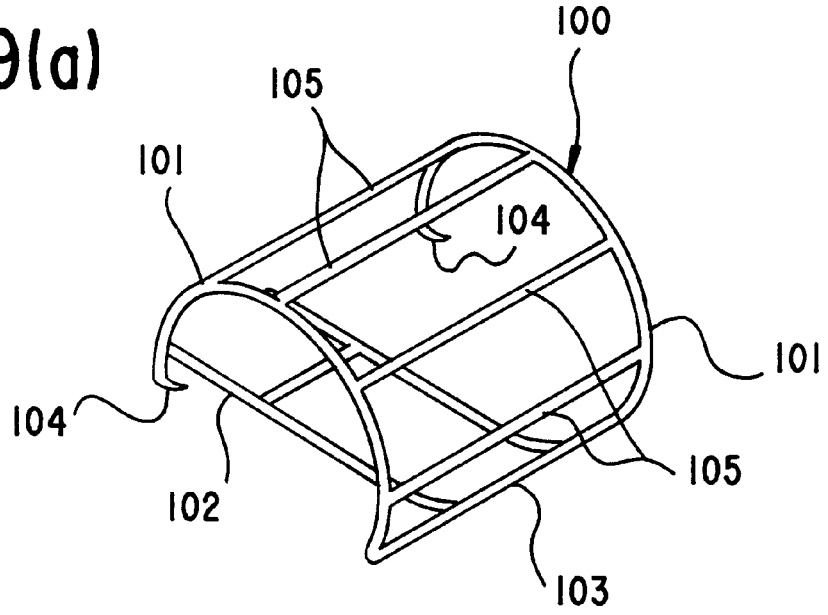
FIG. 29 is a schematic perspective view illustrating a modification of the stopper shown in FIG. 28.
Figure 29B:
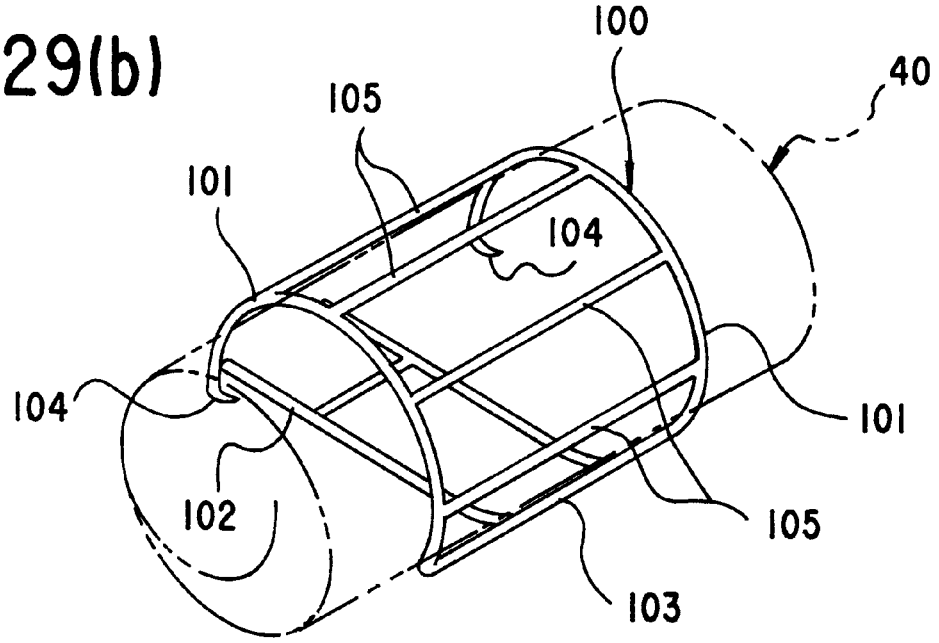
Figure 30A:
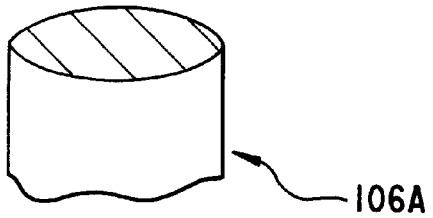
FIGS. 30A to 30G are schematic perspective views for describing the shape of a rod in section for use in the present invention.
Figure 30B:
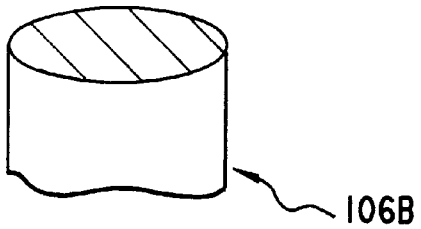
Figure 30C:
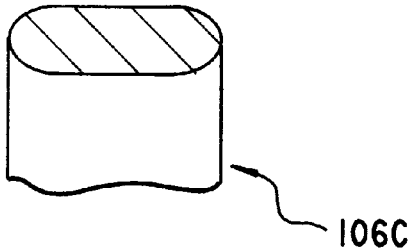
Figure 30D:
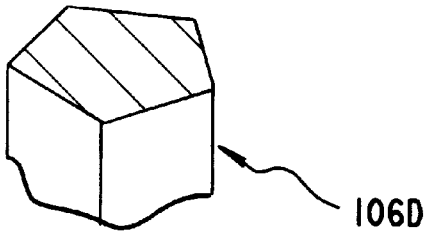
Figure 30E:
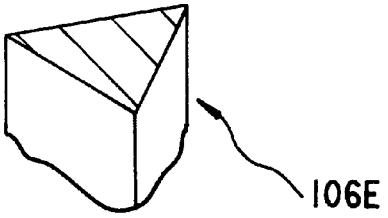
Figure 30F:
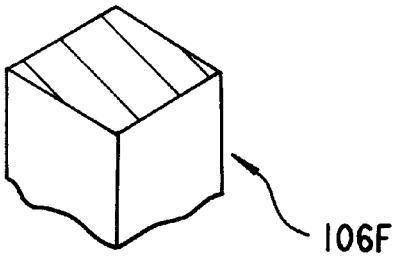
Figure 30G:
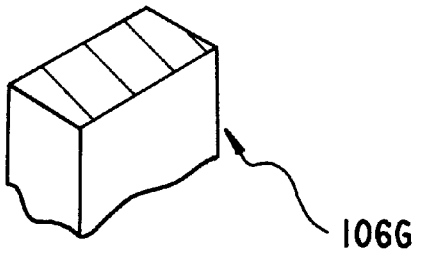
Figure 31:
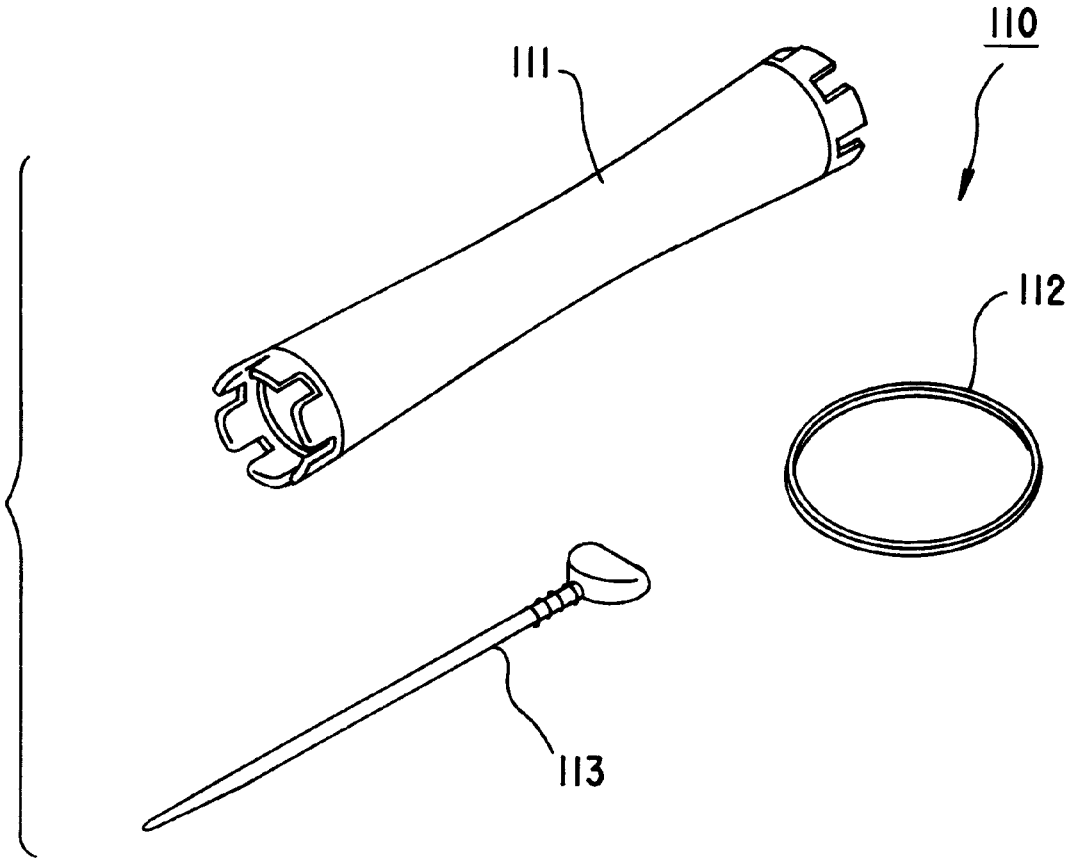
FIG.31 PRIOR ART
FIG. 31 is a schematic perspective view illustrating a conventional hair roller.
Figure 32A:
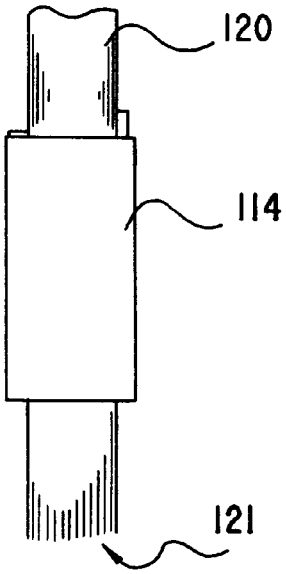
FIG.32(a) PRIOR ART
FIGS. 32A to 32D are views illustrating a method of winding hair onto the conventional hair roller.
Figure 32B:
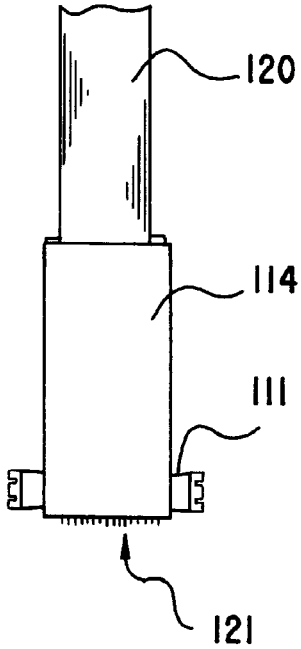
FIG.32(b) PRIOR ART
Figure 32C:
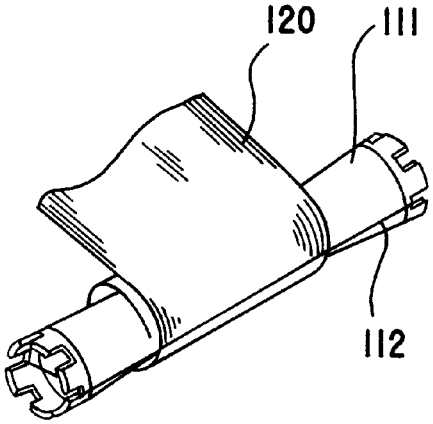
FIG.32(c) PRIOR ART
Figure 32D:
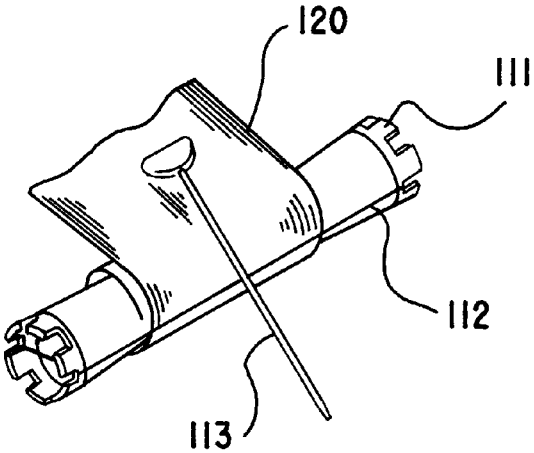
FIG.32(d) PRIOR ART

FIGS. 28 and 29 illustrates examples of another wind maintaining means (a wind maintaining means C). A stopper 100 shown in FIG. 28 comprises a C-shaped ring portion 101 for holding the rod around which hair is wound and a leg portion 102 as a rotation-stop extended from an end of the ring portion 101 to maintain the state of the hair wound around the rod with tension. More specifically, the stopper 100 is formed of a material with resilient restitution, and has a pair of C-shaped ring portions 101 on both sides with their one end being made integral by a connecting portion 103. The leg portion 102 is provided so as to extend from the connecting portion 103 to an unconnected end of a ring portion 101. Unconnected ends of the ring portions 101 are provided with claws 104 for preventing idle running of the rod by catching the rod. The stopper 100 shown in FIG. 29 is provided with the structure described in the above, and in addition, with a plurality of hair supports 105 and so on between the ring portions 101. The whole stopper 100 may be formed of metal wires and may be integrally formed of synthetic resin.

Though cases where the rod of the hair roller is cylindrical are described in Embodiments 1 to 8, it goes without saying that the rod is not limited to a cylindrical one. Rods which can be used in the present invention may be, for example, as shown in FIGS. 30A to G, rods 106A to 106G which are a cylinder which is oval in section, a prism which is polygon in section, and others with various shapes in section.

Further, though some of Embodiments 1 to 8 are described only in case only the wind maintaining means A, B, or C is used, but the present invention is not limited thereto. In another embodiment, for example, a securing body such as the pin 13 shown in FIG. 1 may be used as a winding means and may be inserted into a portion of a rod or of a hair bundle wound around a rod to maintain the state of the hair 120 wound around the rod with tension.

As described in the above, according to the present invention, since a hair roller comprises a rod having a hair winding portion where at least a portion around which hair is wound is resiliently restitutively compressed and deformed and also having a hair distal end retaining means for retaining distal ends of hair, and a wind maintaining means for maintaining the state of hair wound around the rod with tension, no special skill for winding hair which is conventionally required is necessary, and, even an amateur or a beautician who lacks experience can easily wind hair with very good operativity. Further, since hair is wound with its distal ends being retained, there is no fear that the hair is wound with its distal ends folded, and even if the length of the distal ends of the hair is uneven, the distal ends of the hair can be neatly retained in the rod. Further, since tension toward the outside is always acting on the wound hair due to shape restitutive force of the hair winding portion which is resiliently restitutively compressed and deformed. Therefore, the hair can be curled more firmly and beautifully.

Further, in case, for example, the present invention is used in perming, perming liquid can be applied by soaking the rod with distal ends of hair wound around it in a container containing the perm liquid and by crumpling the rod two or three times. In this case, the perming liquid once applied is retained in the sponge-like body for a long time, which is convenient, and to the contrary, in case the rod is squeezed, the perming liquid can be easily removed.

What is claimed is:

1. A hair roller comprising:

a rod having a hair winding portion where at least a portion around which hair is wound is resiliently restitutively compressed and deformed and also having a hair distal end retaining means for retaining distal ends of hair; and a wind maintaining means for maintaining the state of hair wound around said rod with tension.

2. A hair roller as claimed in claim 1, wherein said wind maintaining means is a covering body having a plurality of covering pieces which are opened by a lever and can cover said rod, said wind maintaining means maintaining the state of hair wound around said rod with tension by pressing by inner surfaces of the covering pieces when the covering body is closed.

3. A hair roller as claimed in claim 1, wherein said wind maintaining means for maintaining the state of hair wound around said rod with tension comprises a C-shaped ring portion for holding said rod around which hair is wound and a leg portion as a rotation-stop extended from an end of the ring portion.

4. A hair roller as claimed in claim 1, wherein said wind maintaining means is a substantially U-shaped tube-type body, both end portions thereof being outlets for fluid and an inlet for the fluid being formed between said end portions, said wind maintaining means maintaining the state of hair wound around said rod with tension by being provided on the hair winding portion so as to press the hair winding portion.

5. A hair roller as claimed in claim 1, wherein said wind maintaining means for maintaining the state of hair wound around said rod with tension comprises a C-shaped ring portion for holding said rod around which hair is wound and a leg portion as a rotation-stop extended from an end of the ring portion.

6. A hair roller comprising:

a rod having a hair winding portion where at least a portion around which hair is wound is resiliently restitutively compressed and deformed and also having a forked portion separated in two by a slit piercing the hair winding portion as a hair distal end retaining means for retaining distal ends of hair; and a wind maintaining means for maintaining the state of hair wound around said rod with tension.

7. A hair roller as claimed in claim 6, wherein said rod is a rod with a hole formed substantially through the center of each separated piece forming the forked portion, and said wind maintaining means comprises clip pieces which can be inserted in the hole and are opened and closed by a lever.

8. A hair roller as claimed in claim 6, wherein said wind maintaining means is a covering body having a plurality of covering pieces which are opened by a lever and can cover said rod, said wind maintaining means maintaining the state of hair wound around said rod with tension by pressing by inner surfaces of the covering pieces when the covering body is closed.

9. A hair roller as claimed in claim 6, wherein said wind maintaining means for maintaining the state of hair wound around said rod with tension comprises a C-shaped ring portion for holding said rod around which hair is wound and a leg portion as a rotation-stop extended from an end of the ring portion.

10. A hair roller comprising:

a rod having a hair winding portion where at least a portion around which hair is wound is resiliently restitutively compressed and deformed and also having a slit formed in the hair winding portion as a hair distal end retaining means; and a wind maintaining means for maintaining the state of hair wound around said rod with tension.

11. A hair roller as claimed in claim 10, wherein a pair of slits is formed on both end portions of said rod, one of the slits being said hair distal end retaining means and the other of the slits being said wind maintaining means for maintaining the state of hair wound around said rod with tension.

12. A hair roller as claimed in claim 10, wherein said rod has a slit piercing a longitudinal middle portion of the hair winding portion as said hair distal end retaining means, and said wind maintaining means is a covering body having a plurality of covering pieces which are opened by a lever and can cover said rod, said wind maintaining means maintaining the state of hair wound around said rod with tension by pressing by inner surfaces of the covering pieces when the covering body is closed.

13. A hair roller as claimed in claim 10, wherein said rod has a slit piercing a longitudinal middle portion of the hair winding portion as said hair distal end retaining means, and said wind maintaining means is a substantially U-shaped tube-type body, both end portions thereof being outlets for fluid and an inlet for the fluid being formed between the both end portions, said wind maintaining means maintaining the state of hair wound around said rod with tension by being provided on the hair winding portion so as to press the hair winding portion.

14. A hair roller as claimed in claim 10, wherein said rod has a slit piercing a longitudinal middle portion of the hair winding portion as said hair distal end retaining means, and said wind maintaining means for maintaining the state of hair wound around said rod with tension comprises a C-shaped ring portion for holding said rod around which hair is wound and a leg portion as a rotation-stop extended from an end of the ring portion.

15. A hair roller as claimed in claim 10, wherein said rod has a slit at least formed in a longitudinal middle portion of the hair winding portion so as not to pierce the hair winding portion and a through hole opened in a hair winding surface to the slit together as said hair distal end retaining means, and said wind maintaining means is a covering body having a plurality of covering pieces which are opened by a lever and can cover said rod, said wind maintaining means maintaining the state of hair wound around said rod with tension by pressing by inner surfaces of the covering pieces when the covering body is closed.

16. A hair roller as claimed in claim 10, wherein said rod has a slit at least formed in a longitudinal middle portion of the hair winding portion so as not to pierce the hair winding portion and a through hole opened in a hair winding surface to the slit together as said hair distal end retaining means, and said wind maintaining means is a substantially U-shaped tube-type body, both end portions thereof being outlets for fluid and an inlet for the fluid being formed between the both end portions, said wind maintaining means maintaining the state of hair wound around said rod with tension by being provided on the hair winding portion so as to press the hair winding portion.

17. A hair roller as claimed in claim 10, wherein said rod has a slit at least formed in a longitudinal middle portion of the hair winding portion so as not to pierce the hair winding portion and a through hole opened in a hair winding surface to the slit together as said hair distal end retaining means, and said wind maintaining means for maintaining the state of hair wound around said rod with tension comprises a C-shaped ring portion for holding said rod around which hair is wound and a leg portion as a rotation-stop extended from an end of the ring portion.

18. A hair roller as claimed in claim 10, wherein said rod has a slit at least formed in a longitudinal middle portion of the hair winding portion so as not to pierce the hair winding portion and a first through hole opened in a hair winding surface to the slit together as said hair distal end retaining means, and also has a second through hole formed in a rod body so as to lead to the first through hole, and said wind maintaining means for maintaining the state of hair wound around said rod with tension is a pin.inserted through the first and second through holes.

19. A hair roller as claimed in claim 15, wherein the slit is formed over the full length of the hair winding portion.

20. A hair roller as claimed in claim 16, wherein the slit is formed over the full length of the hair winding portion.

21. A hair roller as claimed in claim 17, wherein the slit is formed over the full length of the hair winding portion.

22. A hair roller as claimed in claim 18, wherein the slit is formed over the full length of the hair winding portion.

23. A hair roller comprising:

a rod having a hair winding portion where at least a portion around which hair is wound is resiliently restitutively compressed and deformed and having a first slit piercing a longitudinal middle portion of the hair winding portion and further having a forked portion separated in two by a second slit piercing the hair winding portion, any one of the first slit and the forked portion being said hair distal end retaining means; and a wind maintaining means for maintaining the state of hair wound around said rod with tension.

24. A hair roller as claimed in claim 23, wherein said wind maintaining means is a covering body having a plurality of covering pieces which are opened by a lever and can cover said rod, said wind maintaining means maintaining the state of hair wound around said rod with tension by pressing by inner surfaces of the covering pieces when the covering body is closed.

25. A hair roller as claimed in claim 23, wherein said wind maintaining means is a substantially U-shaped tube-type body, both end portions thereof being outlets for fluid and an inlet for the fluid being formed between the both end portions, said wind maintaining means maintaining the state of hair wound around said rod with tension by being provided on the hair winding portion so as to press the hair winding portion.

26. A hair roller as claimed in claim 23, wherein said wind maintaining means for maintaining the state of hair wound around said rod with tension comprises a C-shaped ring portion for holding said rod around which hair is wound and a leg portion as a rotation-stop extended from an end of the ring portion.

* * * * *